United States Patent [19]

Davies et al.

[11] 4,019,413

[45] Apr. 26, 1977

[54] PACKING MACHINES

[75] Inventors: Robert William Davies; Leonard Richard Wager, both of Deptford, England

[73] Assignee: Molins Limited, London, England

[22] Filed: Nov. 11, 1974

[21] Appl. No.: 522,798

[30] Foreign Application Priority Data

Nov. 15, 1973 United Kingdom ..... 53158/73

[52] U.S. Cl. ..... 83/88; 271/91

[51] Int. Cl.[2] ..... B26D 7/06; B65H 3/40

[58] Field of Search ..... 83/88, 42, 408, 302, 83/256; 53/210, 203; 271/9, 91, 92, 194

[56] References Cited

UNITED STATES PATENTS

| | | | |
|---|---|---|---|
| 2,590,222 | 3/1952 | van Veen | 271/9 |
| 2,751,981 | 6/1956 | Hawkins | 83/302 X |
| 3,274,870 | 9/1966 | Schmermund | 83/88 |
| 3,301,116 | 1/1967 | Owen | 83/408 |

*Primary Examiner*—Leon Gilden
*Attorney, Agent, or Firm*—John C. Smith, Jr.

[57] ABSTRACT

Wrappers of metallic foil are formed around groups of articles to be packed, in a machine which comprises a cigarette hopper, a cigarette bundle conveyor, a metallic foil feeding assembly, a foil conveyor, a cigarette compression device, a foil folding and tucking unit, a bundle transfer unit and a bundle orientation and ejection unit.

Bundles of cigarettes are fed from the hopper into pockets on the bundle conveyor from which they are removed two at a time, at spaced locations, and pushed into the compression device. A single web of metallic foil is supplied to the foil feeding assembly which produces pieces of foil consisting of two overlapped portions which are fed, in turn, to the foil conveyors. The bundles are removed from the compression device and the pieces of foil are formed around the bundles as they are conveyed through the foil folding and tucking unit.

The wrapped bundles are then fed into the bundle transfer unit which brings them closer together, after which the bundles are pushed into pockets on the bundle orientation and ejection unit, which comprises an intermittently rotatable turntable. While on the latter the bundles are orientated on each stepwise movement so that further operations may be carried out, including ejecting the bundles separately, or together, from the turntable at either of two positions.

5 Claims, 31 Drawing Figures

PACKING MACHINES

Figure 1:
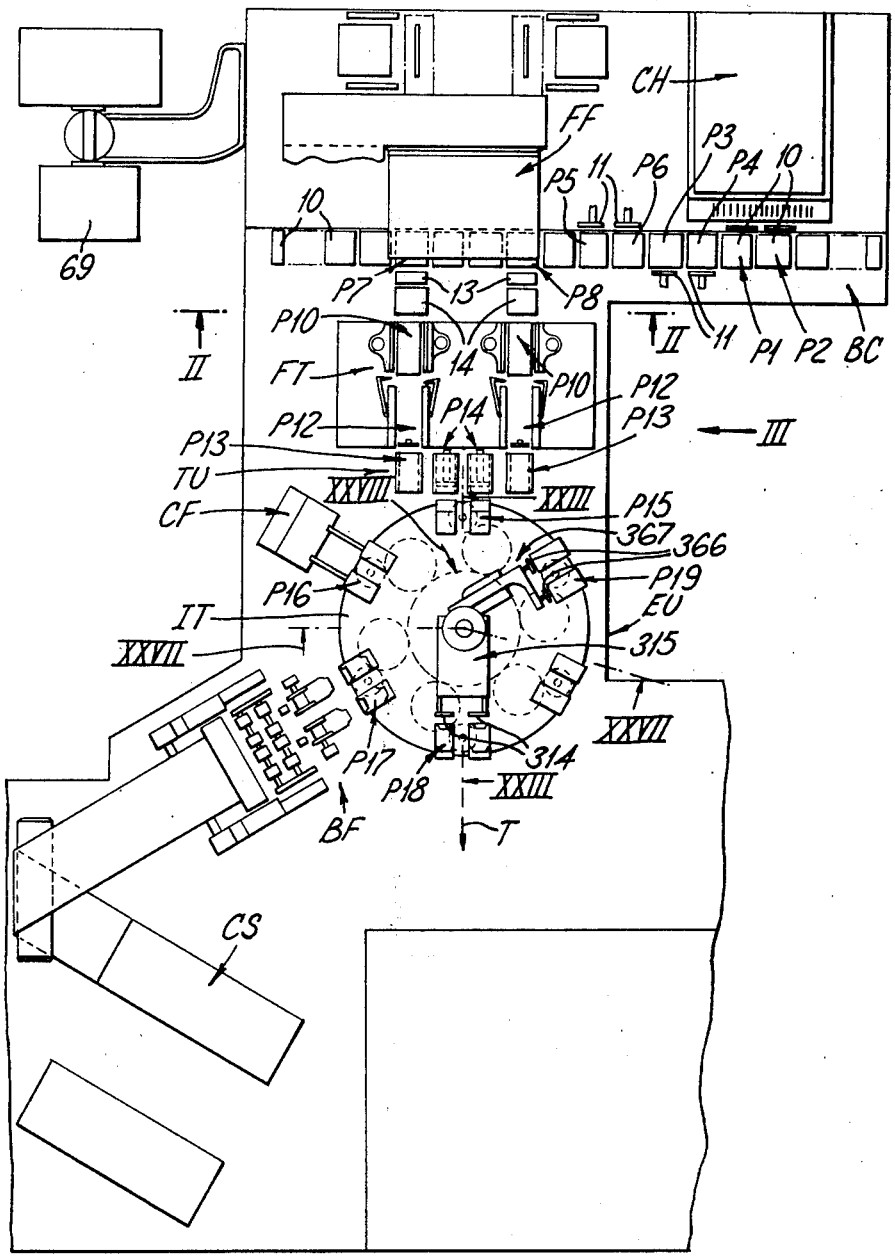

This invention concerns improvements in or relating to packing machines, and in particular to machines which are suitable for packing cigarettes.

When packing cigarettes certain operations are carried out, namely, a bundle of cigarettes is first formed, the bundle is then wrapped in an inner wrapper e.g. of metallic foil, and a packet blank is folded and stuck around the bundle to form a packet containing the bundle.

The present invention is concerned with machines which first form bundles of cigarettes, then wrap each bundle in metallic foil, and commence the introduction of each bundle to its packet by bringing together the bundle and an "inner frame" of a packet of the now well known hinged lid (flip top) type. The wrapped bundles are then fed to another machine to have packet blanks formed round them to produce a filled packet. A suitable machine, for performing the last-mentioned operations, and for use in conjunction with the machine of the present invention is that described and illustrated in co-pending application No. 7858/73. However, the invention is not limited to wrapping bundles of cigarettes in an inner wrapper which is then to be enclosed in a packet, but could be applied to machines for enclosing bundles of articles in a wrapper.

According to the present invention there is provided apparatus for forming inner wrappers e.g. of metallic foil around articles to be packed, e.g. groups of cigarettes, in which means for cutting wrapper pieces from a continuous web is arranged to supply feed means for carrying successive pieces to two or more conveyors in turn, means for bringing articles to be packed into engagement with said pieces as the latter are discharged from said conveyors, and means for further conveying said articles while folding of the wrapper pieces engaged therewith is being completed.

Further according to the invention there is provided apparatus for forming wrappers around articles comprising, in combination; first feed means for feeding groups of articles, second feed means for feeding a continuous web of wrapper material, means for cutting wrapper pieces from said continuous web, two or more conveyor means for said wrapper pieces, third feed means for feeding successive wrapper pieces to said conveyors in turn, said conveyors being arranged to feed said pieces in a direcion transverse to the direction of movement of said continuous web, means for transferring said groups of articles away from said first feed means, drive means for intermittently driving said transfer means so that two of said groups of articles are brought to rest at spaced predetermined positions, each adjacent one of said two conveyor means, means for removing said two groups of articles from said transfer means and bringing them into engagement with said wrapper pieces as the latter are are discharged from said conveyors, and means for further conveying said groups of articles while folding of the wrapper pieces engaged therewith is being completed.

Further according to the invention there is provided apparatus for feeding wrapper material comprising first means for feeding a continuous web of wrapper material, means for cutting wrapper pieces from said continuous web, a plurality of first conveyor means each adapted to receive and convey wrapper pieces, second feed means for receiving said cut wrapper pieces from said cutting means, a plurality of second conveyor means, each of said second conveyor means being positioned at a different location adjacent said second feed means and adapted to receive wrapper pieces from said second feed means in turn, and transfer means associated with each of said second conveyor means for transferring said wrapper pieces therefrom to one of said first conveyor means.

Further according to the invention there is provided apparatus for forming wrappers for groups of articles, said wrappers consisting of two overlapping pieces of wrapper material comprising, first means for feeding a single web of wrapper material, means for slitting said web lengthwise into two continuous webs, means for cutting pairs of wrapper pieces from said two webs simultaneously, first conveyor means for receiving overlapped pairs of wrapper pieces, second feed means for receiving said pairs of wrapper pieces from said cutting means, second conveyor means positioned adjacent said second feed means and adapted to receive said pairs of wrapper pieces from said second feed means, transfer means associated with said second conveyor means, means for moving said transfer means between said second conveyor means and said first conveyor means, said transfer means comprising a pair of carriers, each adapted to receive one piece of a pair of wrapper pieces, and operating means to move one of said carriers relatively to the other as said transfer means is moved by said moving means, said operating means being adapted to move said one of said carriers towards the other as said transfer means is moved from said second conveyor toward said first conveyor, so as to move said pieces of wrapper material into overlapping relationship.

Further according to the invention there is provided apparatus for forming a wrapper around an article comprising conveyor means to feed a piece of wrapper material, further conveyor means to feed an article into engagement with said piece of wrapper material and along a feed path to a predetermined position thereafalong as a first step in forming said wrapper around said article, operating means, comprising at least one movable folding device, positioned adjacent said feed path, wherein said device is adapted to continue the feeding of said article along said feed path after it has performed a folding operation.

Further according to the invention there is provided apparatus for handling discrete pieces of material comprising, means to feed said pieces of material in succession along a first feed path at a first level, further means to feed said pieces of material in succession along a second feed path at a second level, transfer means for conveying said pieces from said first to said second level, said transfer means having a downwardly facing flat surface having apertures formed therein, means for applying suction to said apertures, wherein said pieces of material are fed onto said surface by said feed means at said first level whilst suction is being applied to said apertures, and said pieces are removed from said surface by said further feed means at said second level, after suction has been removed from said apertures.

Further according to the invention there is provided apparatus for conveying articles comprising a turntable, drive means for intermittently rotating said turntable, a plurality of carrying devices mounted on said turntable, each device including at least one pocket for accommodating an article therein, first pusher means for inserting an article, at a first location into a pocket, whilst said turntable is stationary, second and third pusher means for ejecting an article, at second and third locations respectively, from a pocket, whilst said turntable is stationary, operating means, connected to both said second and third pusher means, adapted to operate said second and third pusher means simultaneously, each time said turntable comes to rest.

Further according to the invention there is provided apparatus for conveying articles comprising a pair of movable carrier means, means for moving said carrier means intermittently in opposite directions, first holder means mounted on one of said carrier means, second holder means mounted on the other of said carrier means, means for inserting an article into each of said first and second holder means when the latter are each stationary at an insertion position, means for removing an article from each of said first and second holder means when the latter are each stationary at an ejection position, wherein said pair of carrier means are so positioned that when said first and second holders are at said insertion position they are spaced a first distance apart, and when said first and second holder means are at said ejection position they are spaced a second and different distance apart.

Figure 2:
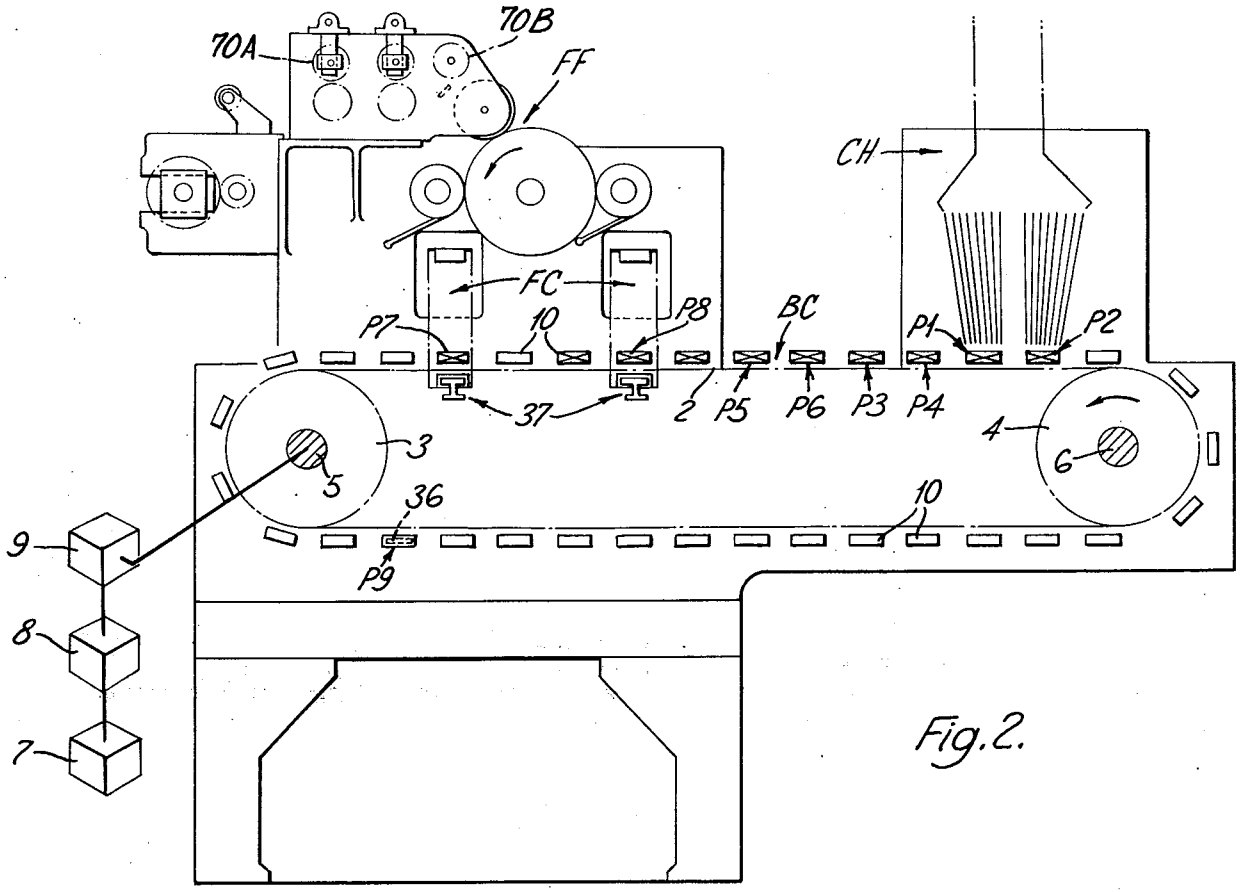
Figure 3:
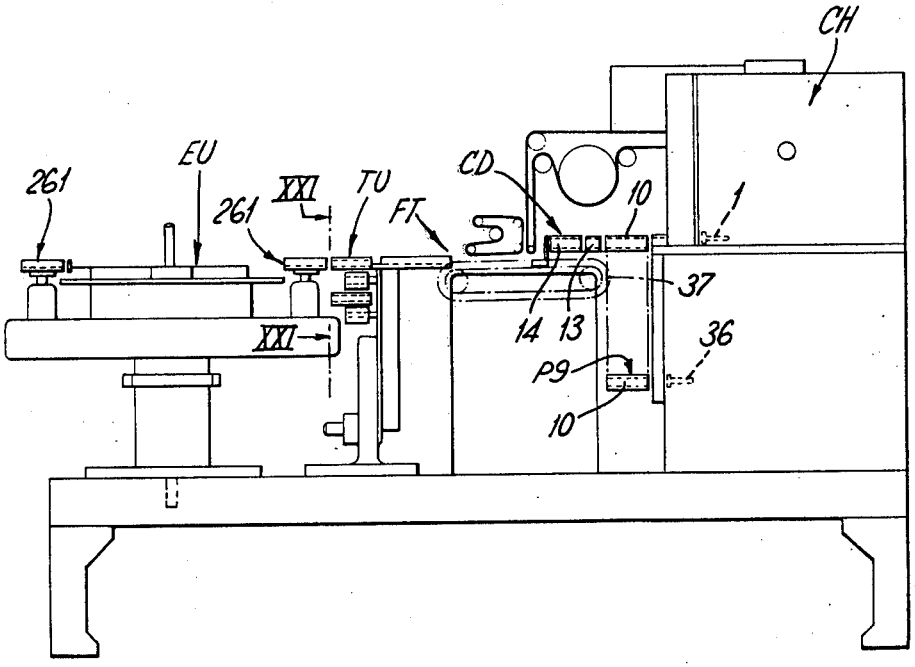
Figure 4:
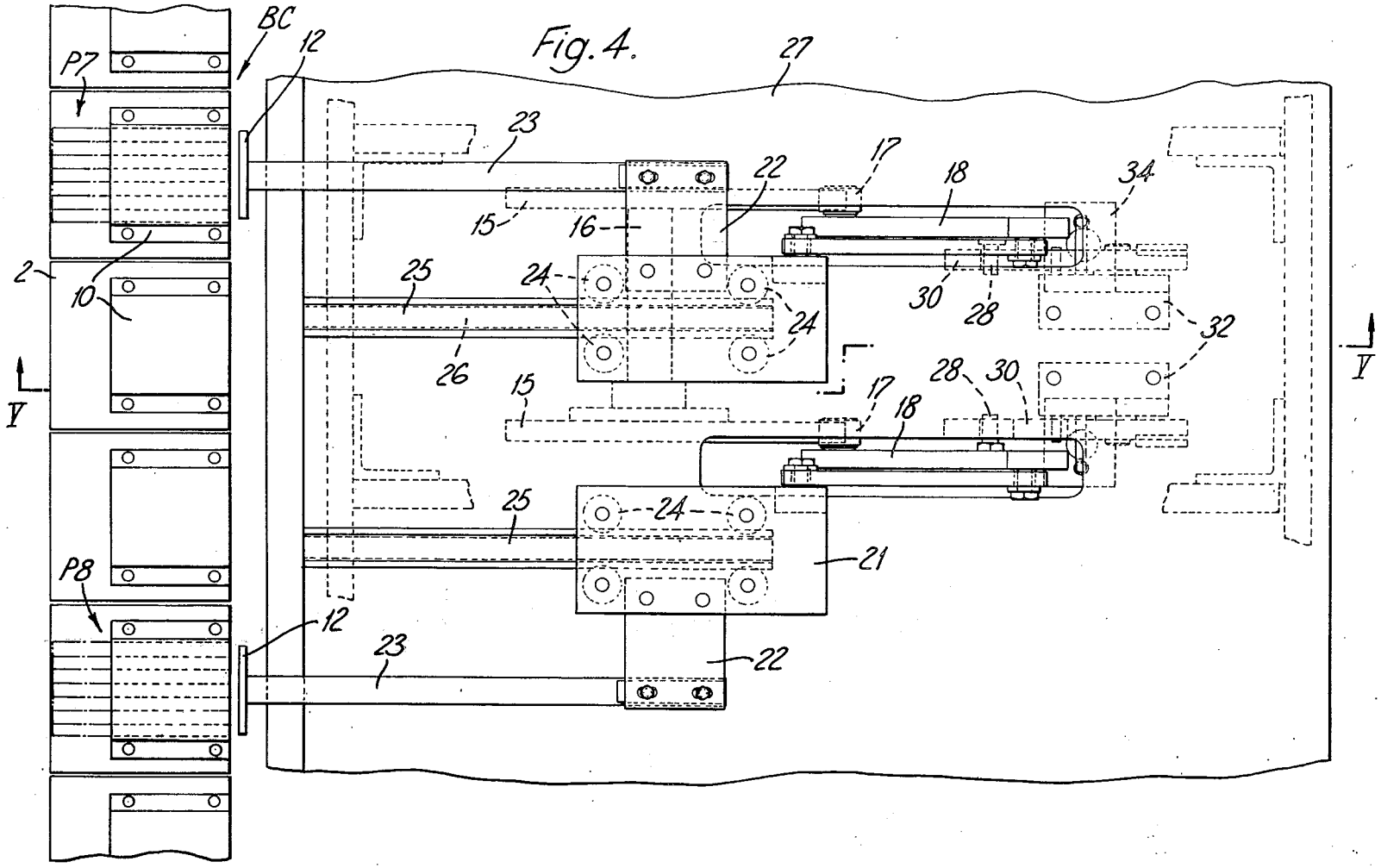
Figure 5:
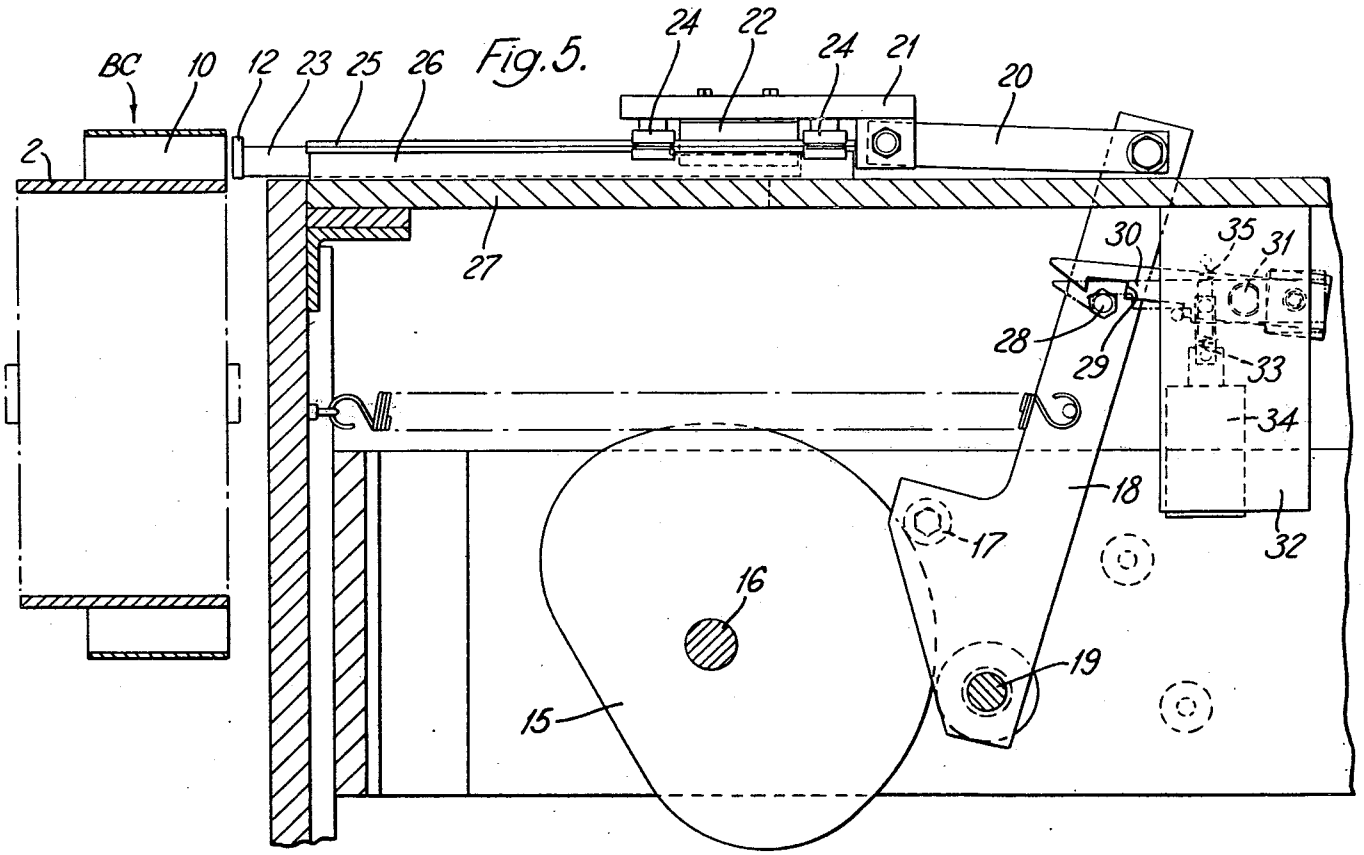
Figure 6:
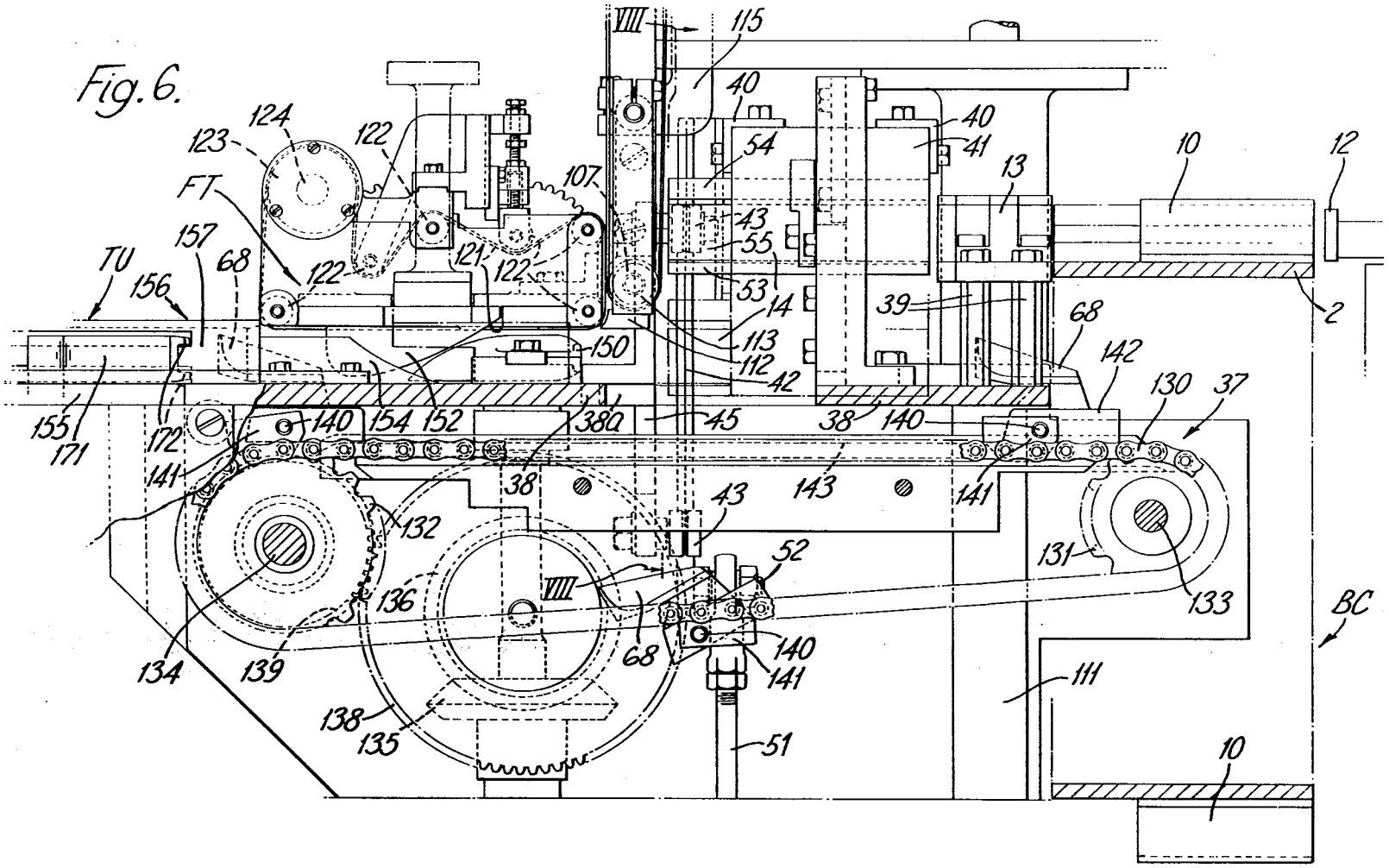
Figure 6A:
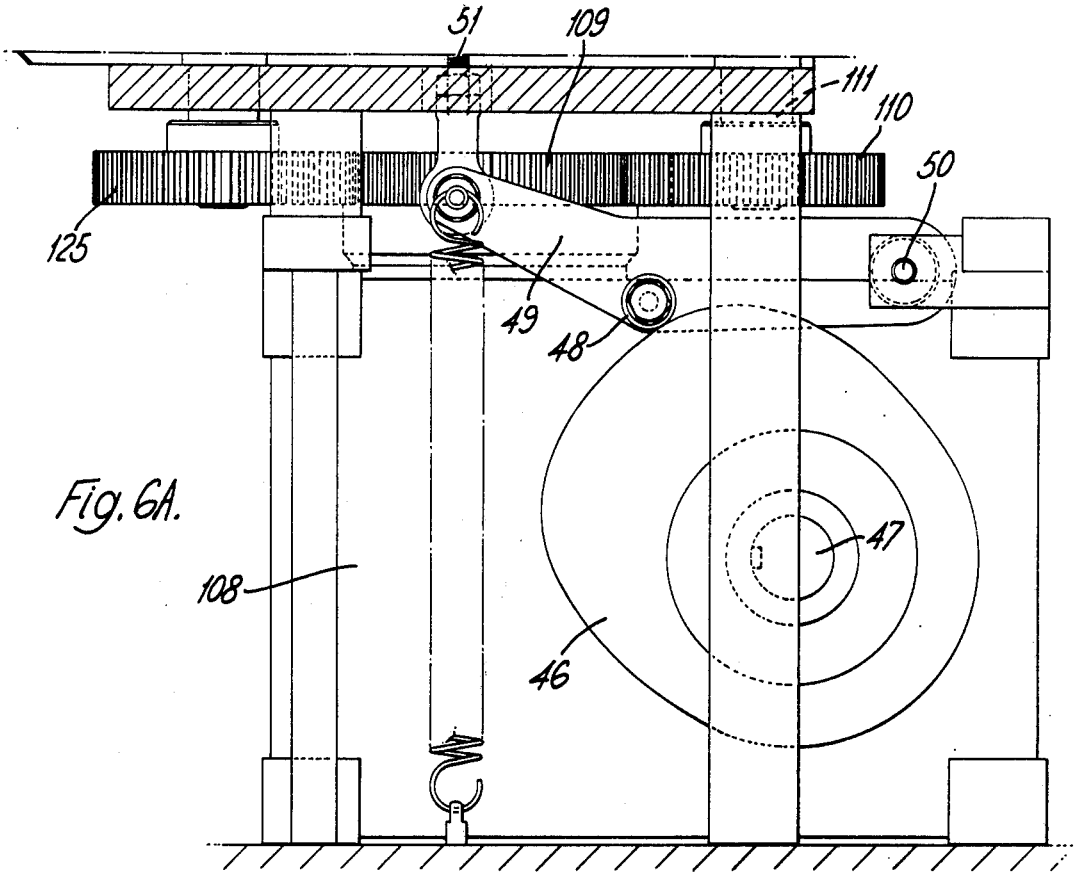
Figure 7:
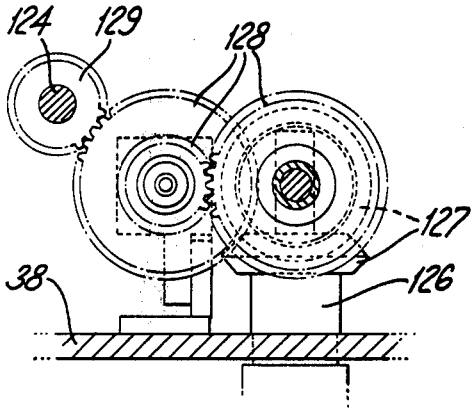
Figure 8:
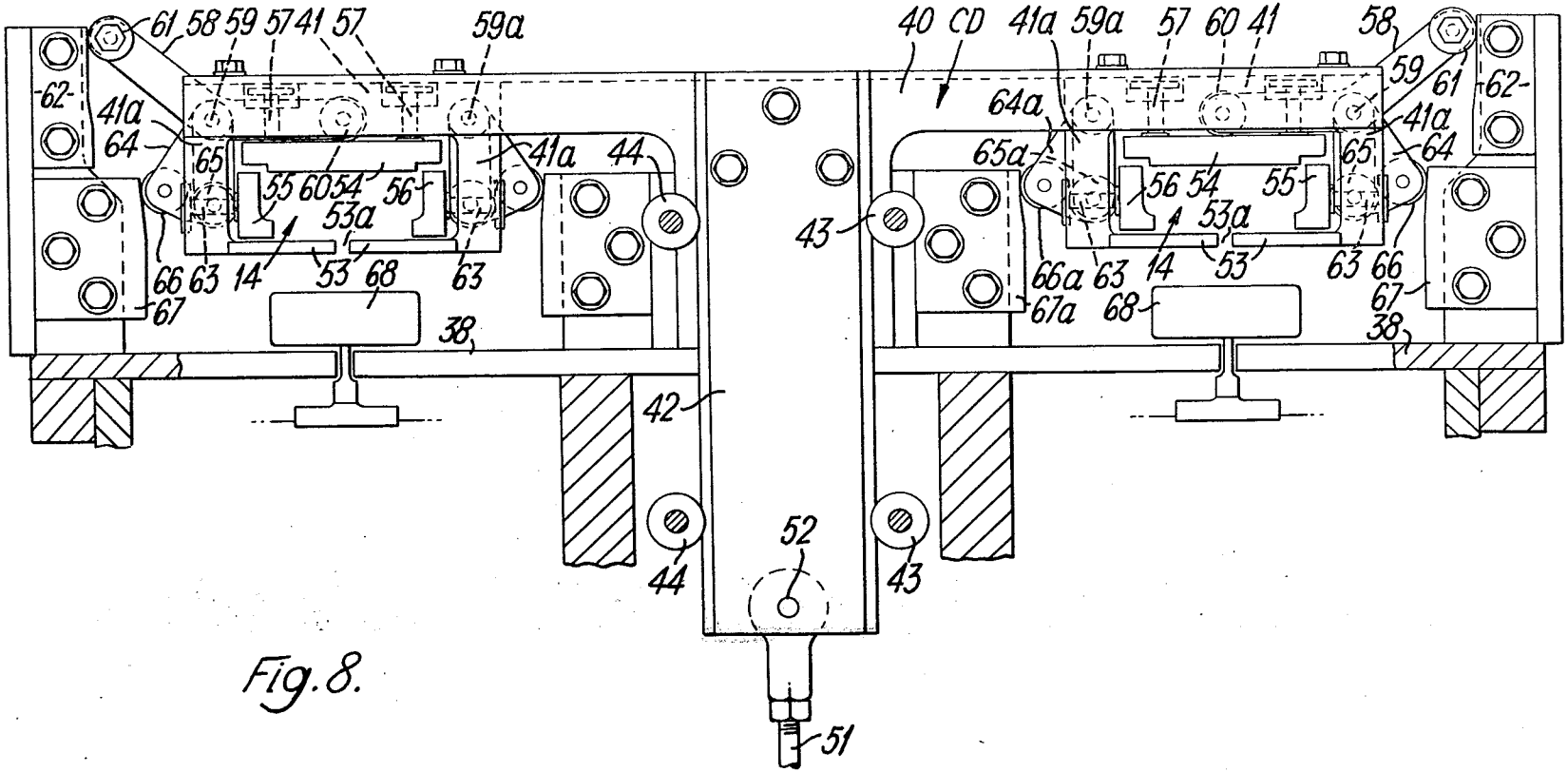
Figure 9:
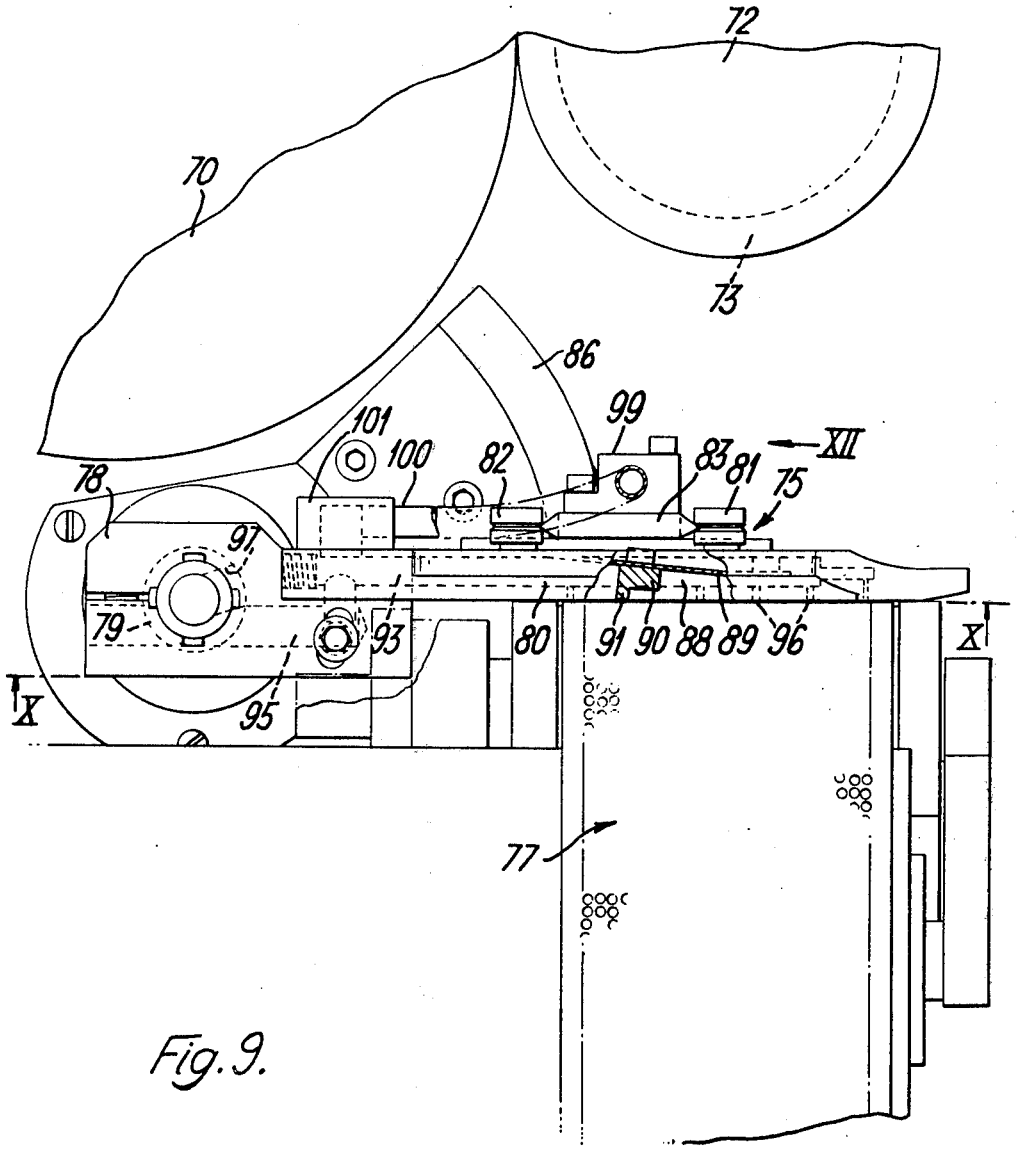
Figure 10:
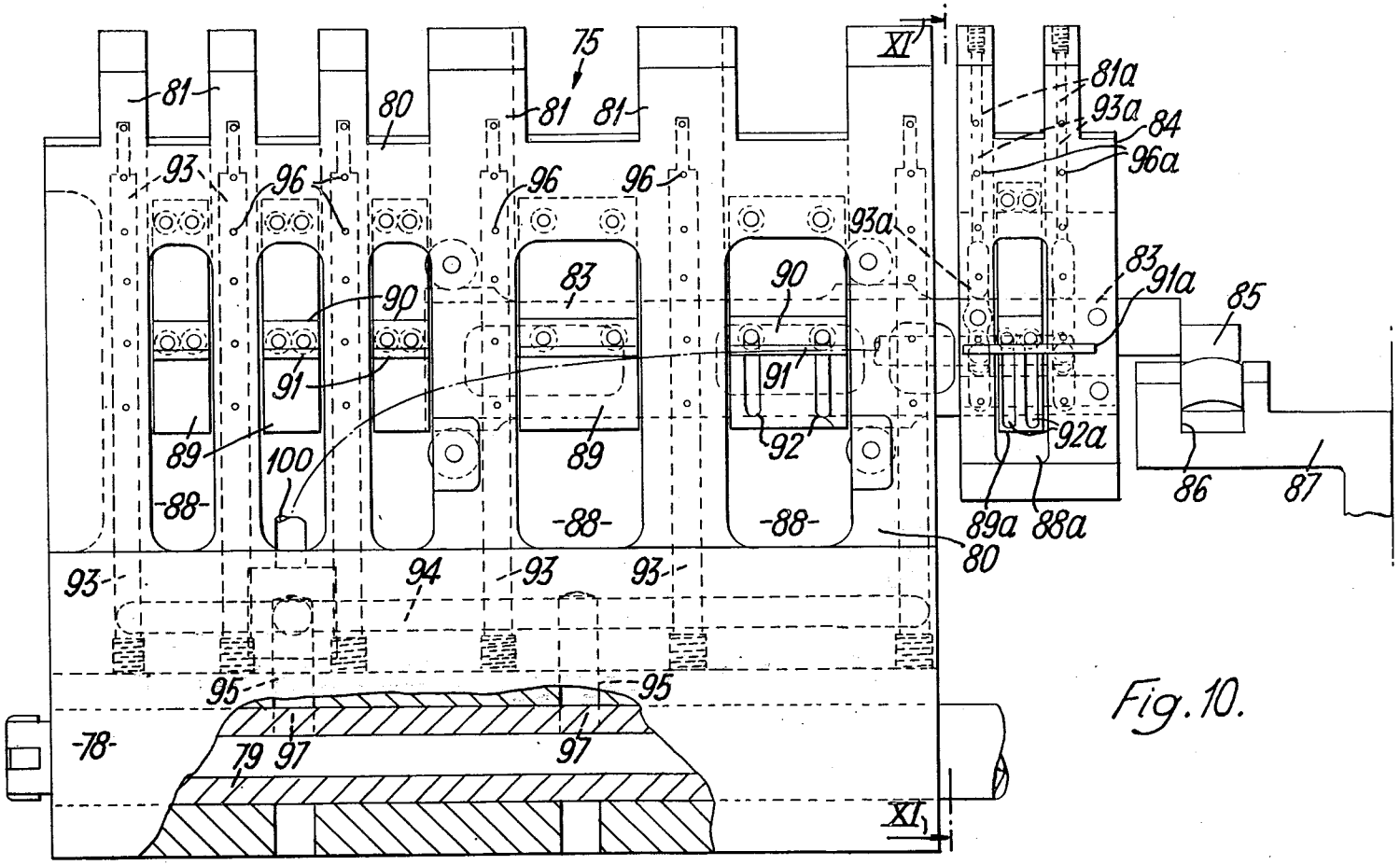
Figure 11:
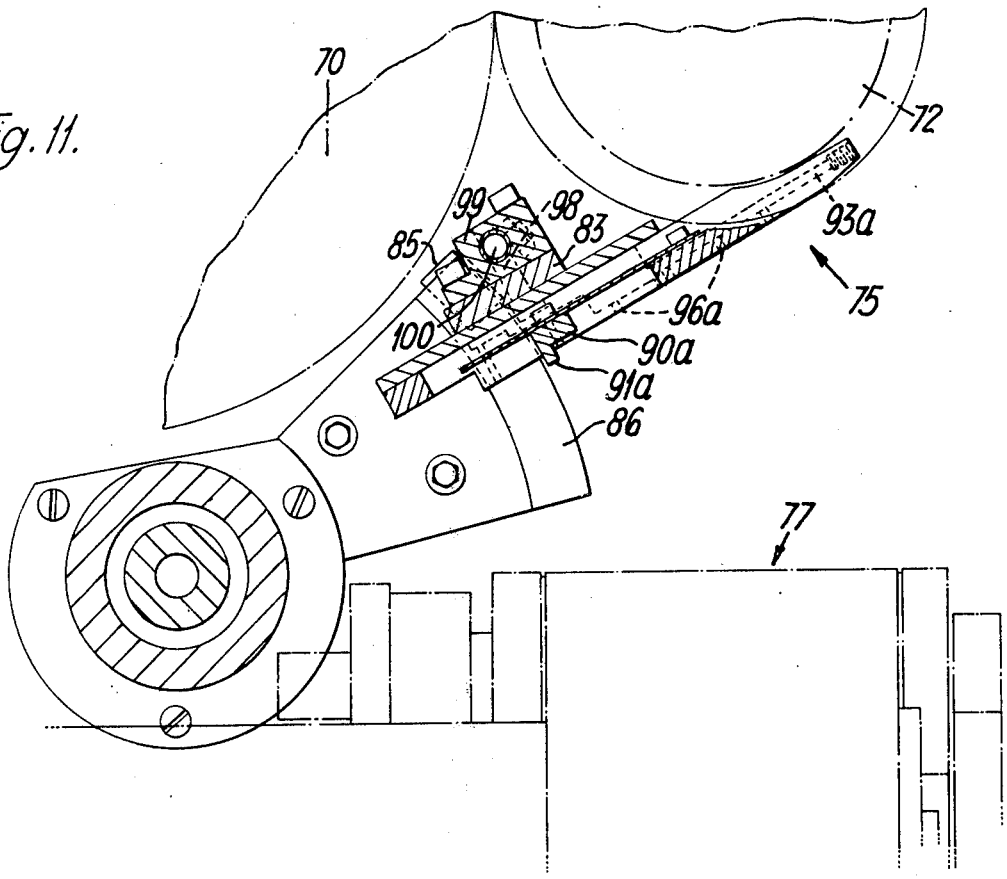
Figure 12:
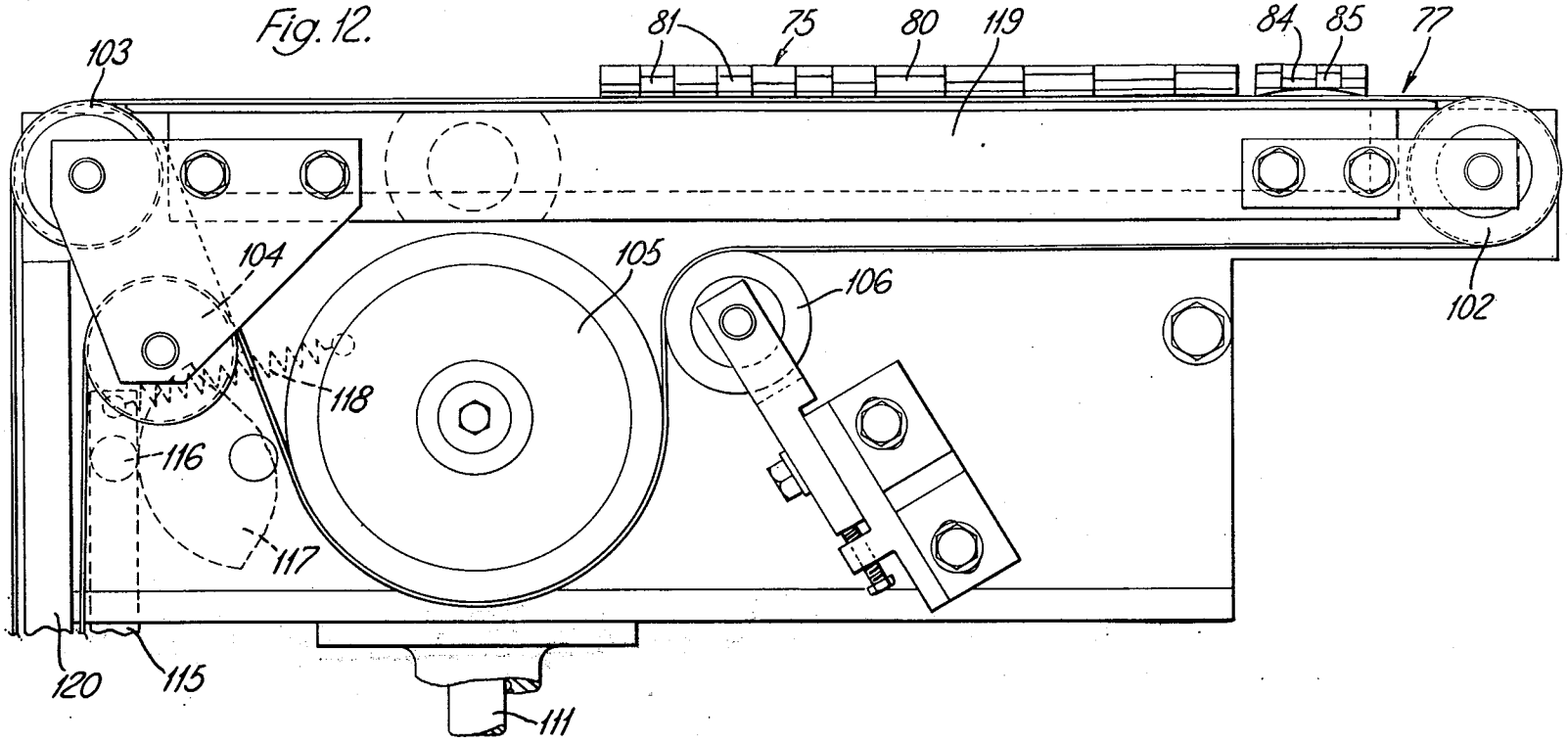
Figure 13:
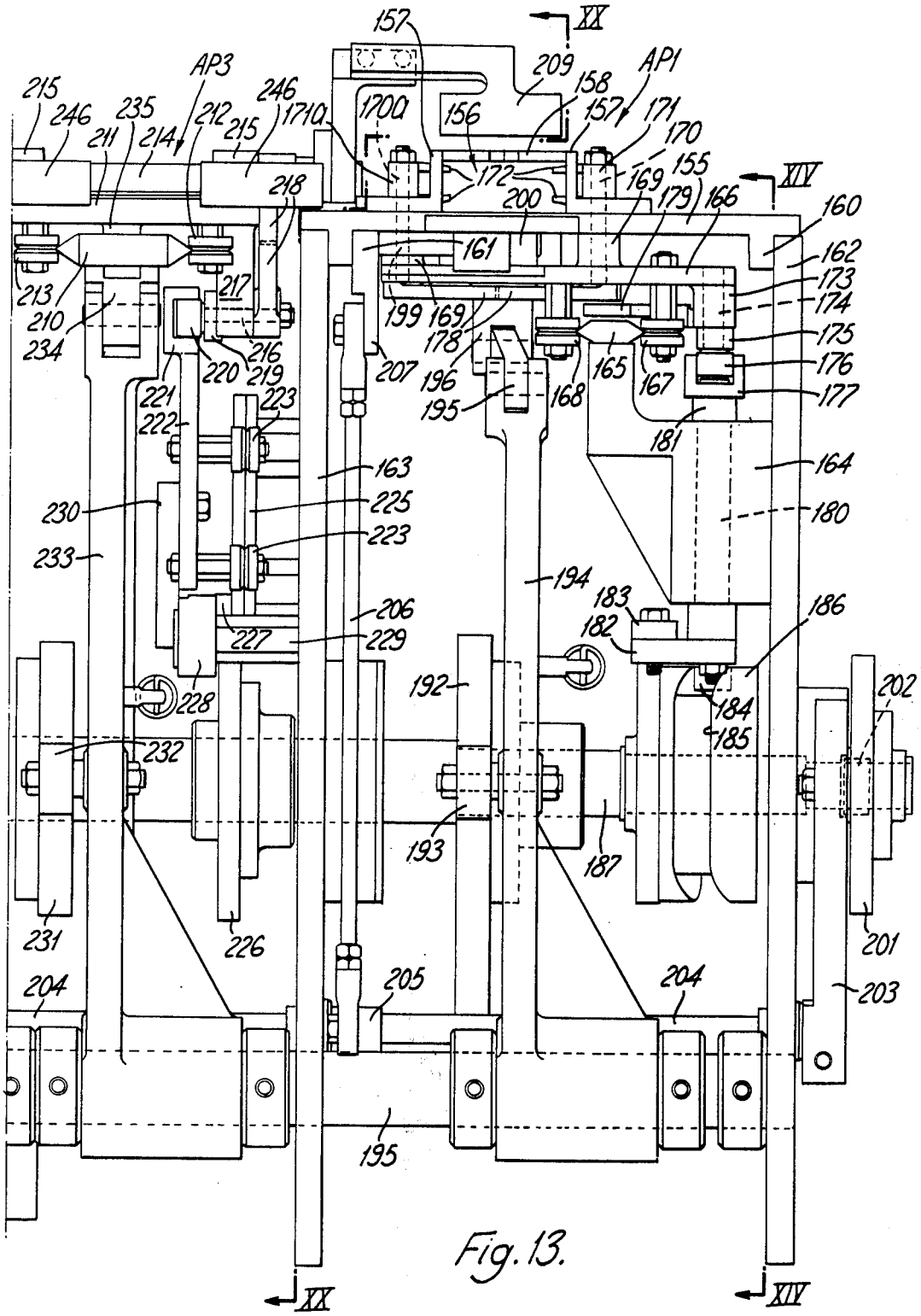
Figure 13A:
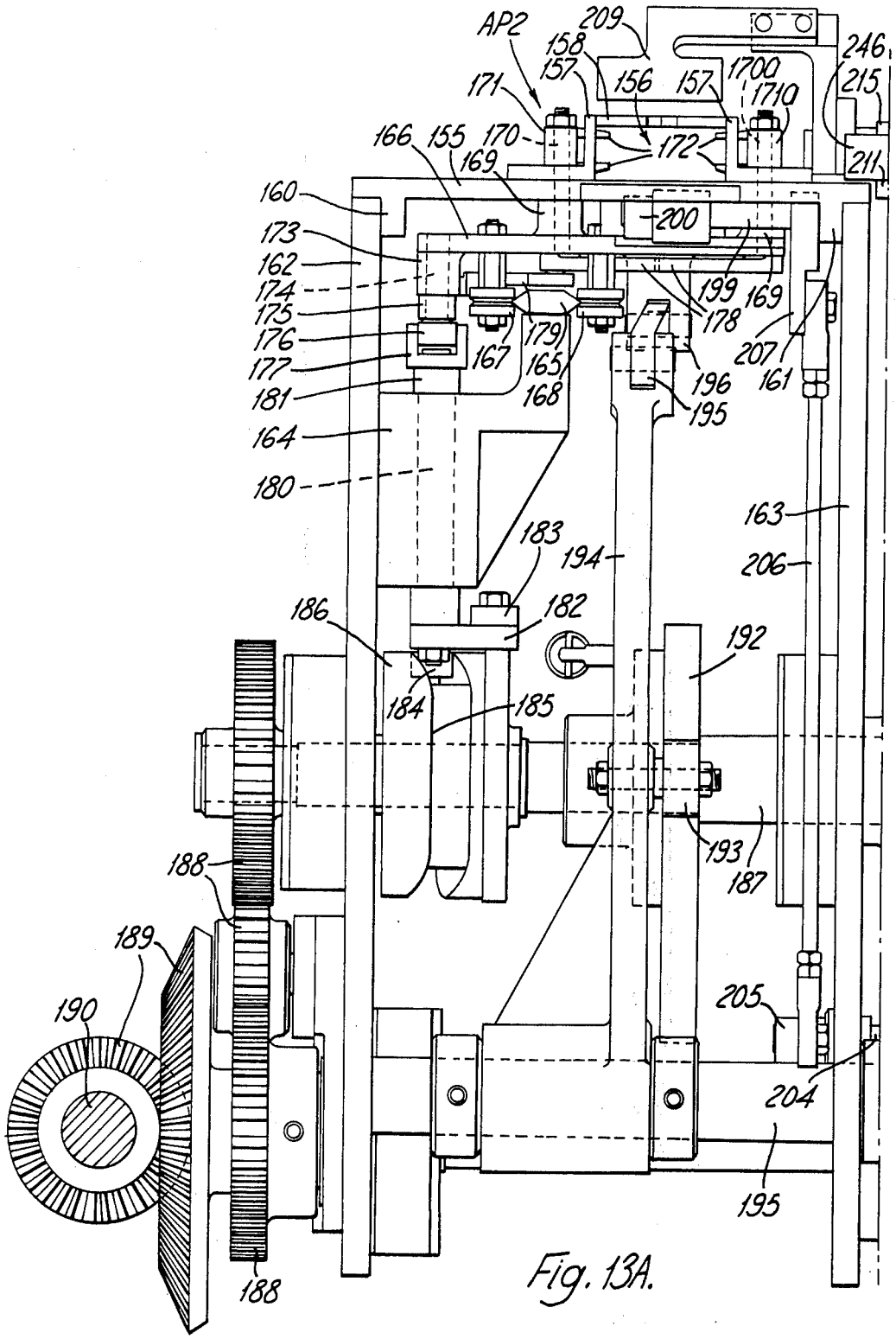
Figure 14:
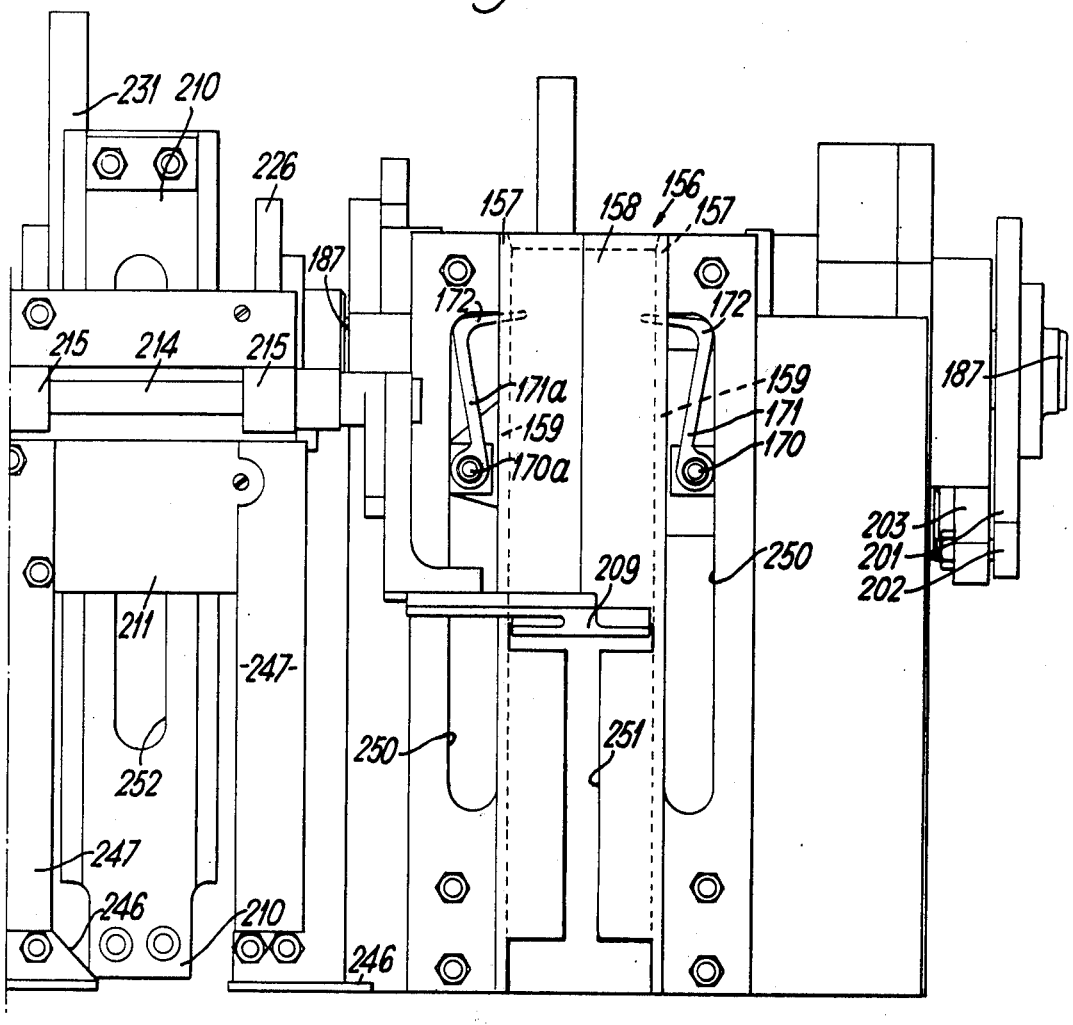
Figure 14A:
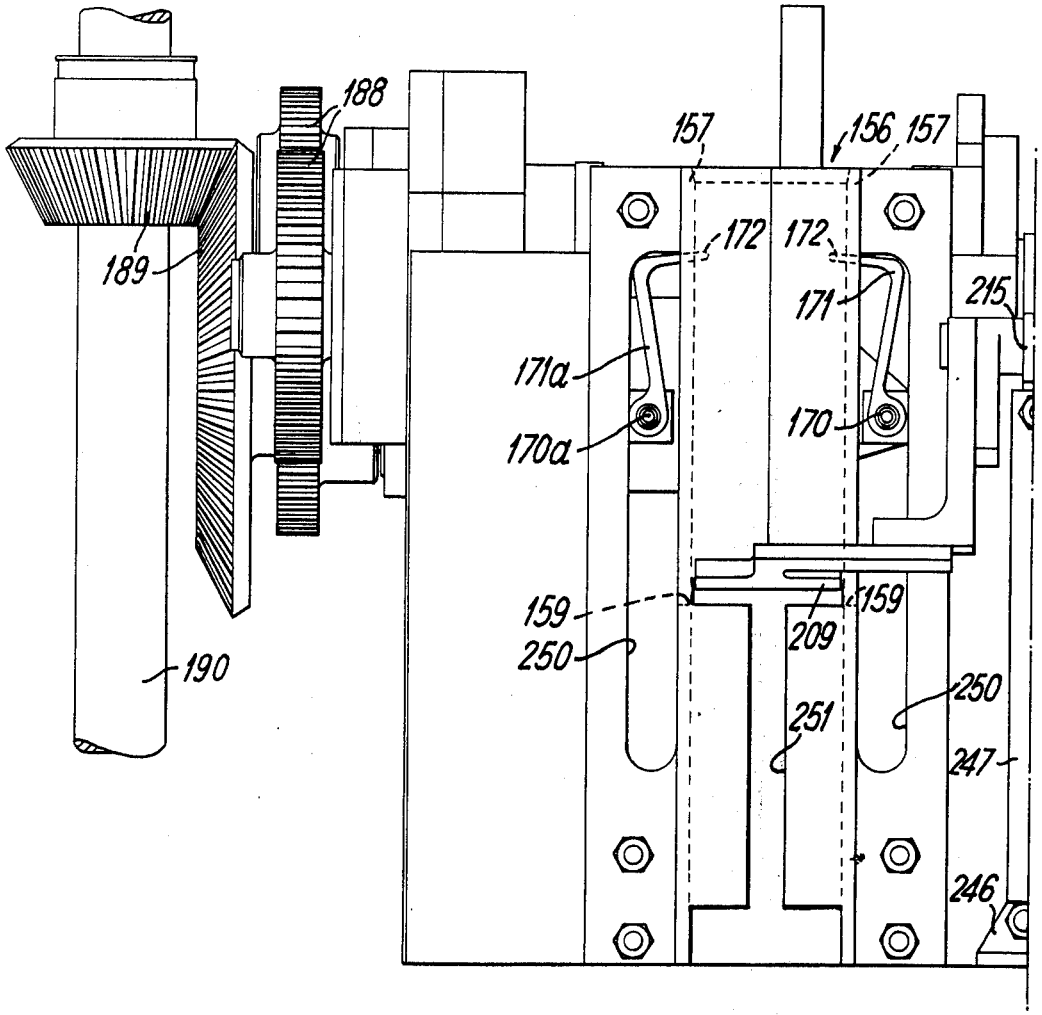
Figure 15:
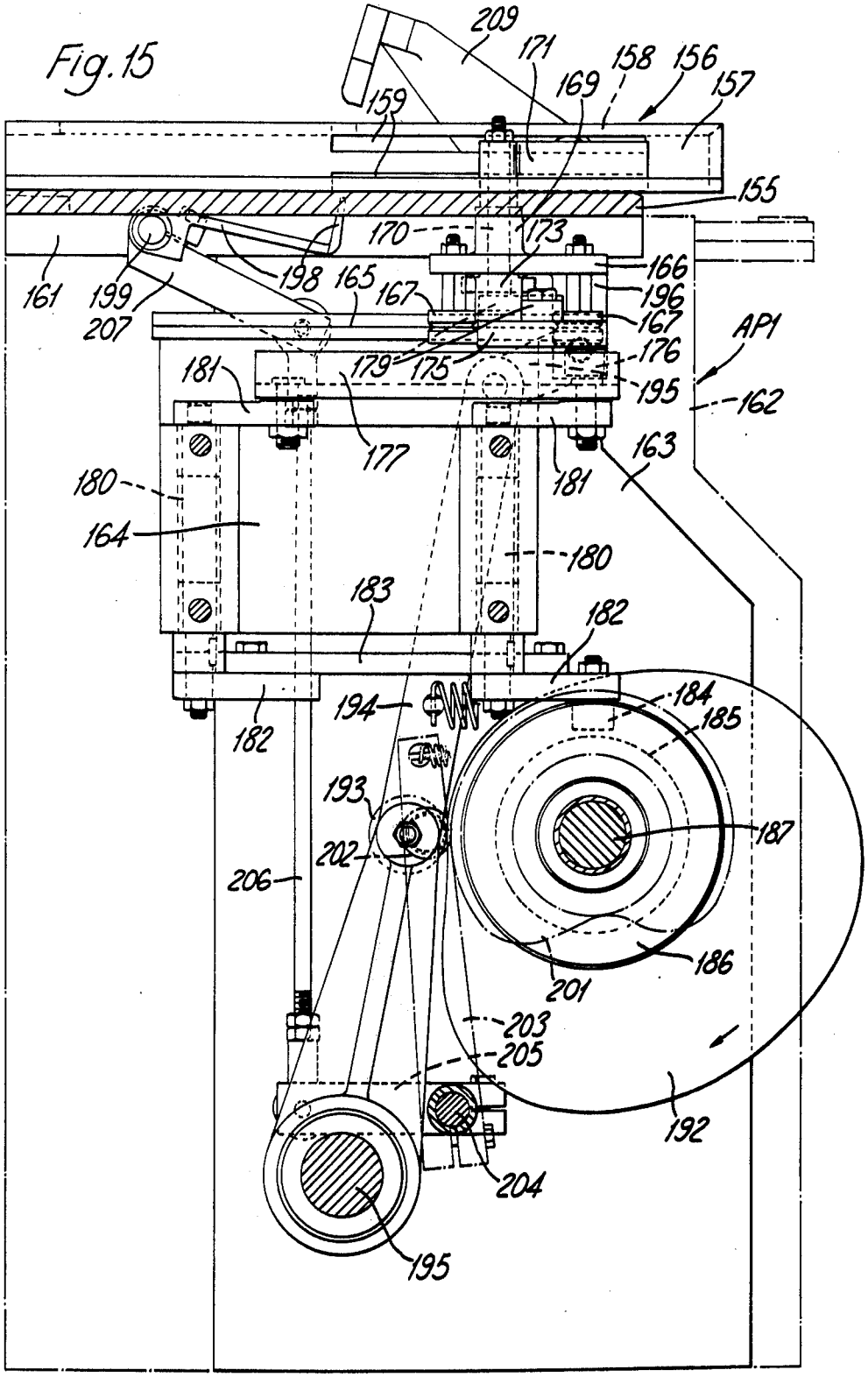
Figure 19:
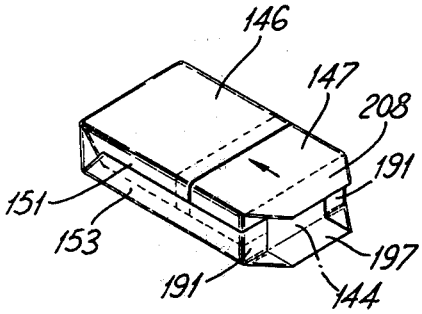
Figure 20:
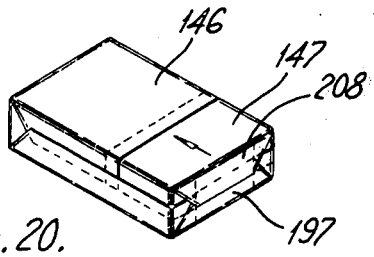
Figure 21:
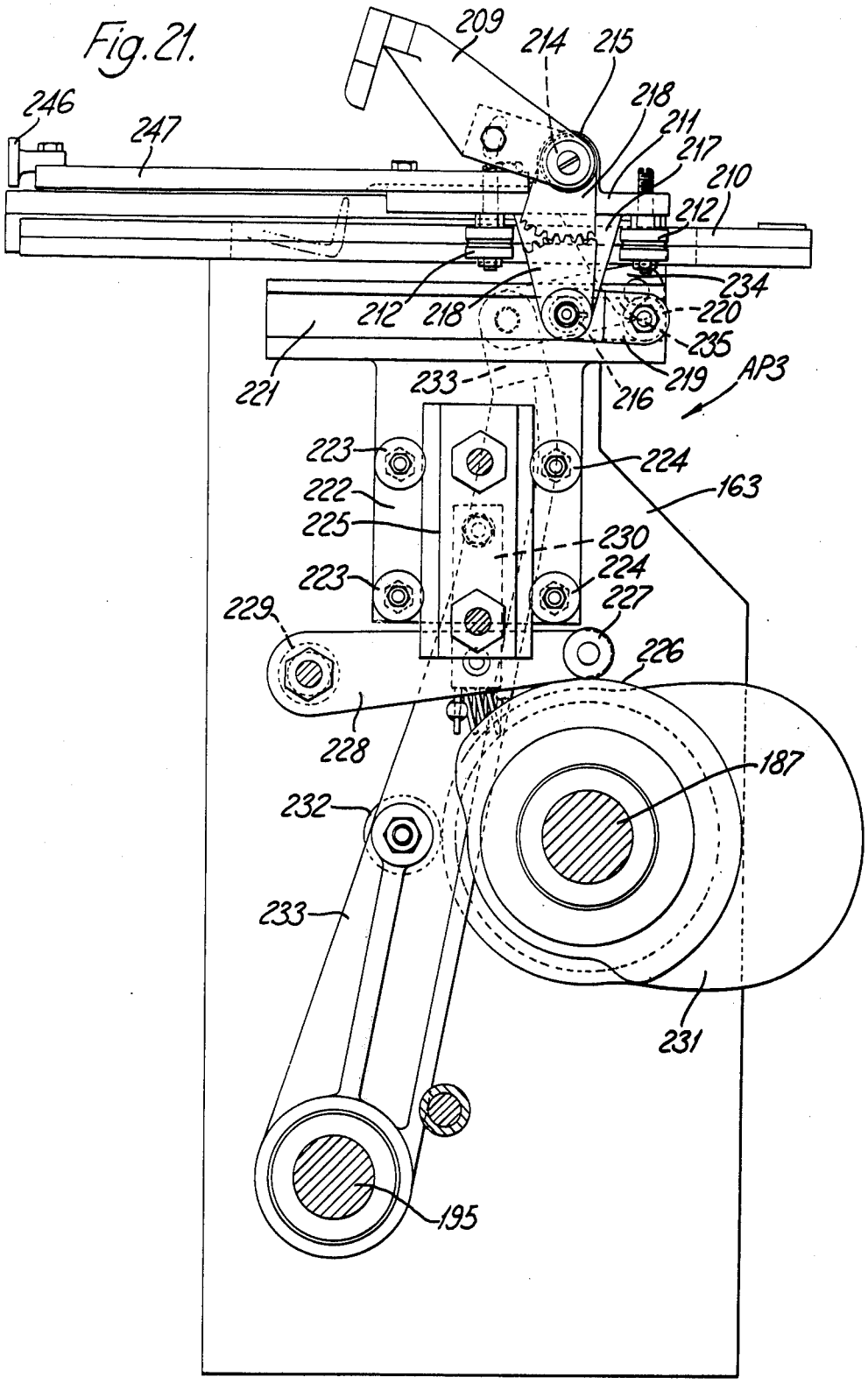
Figure 22:
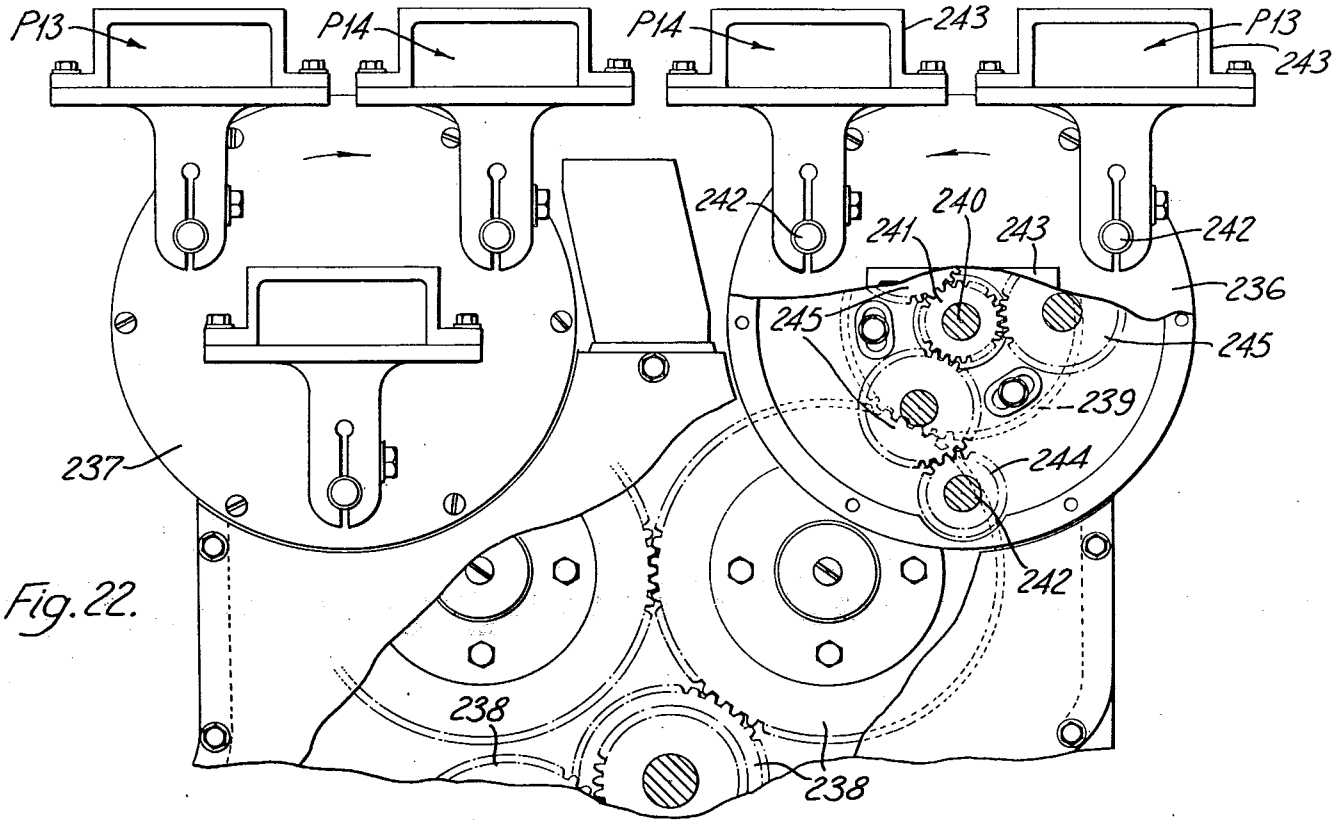
Figure 23:
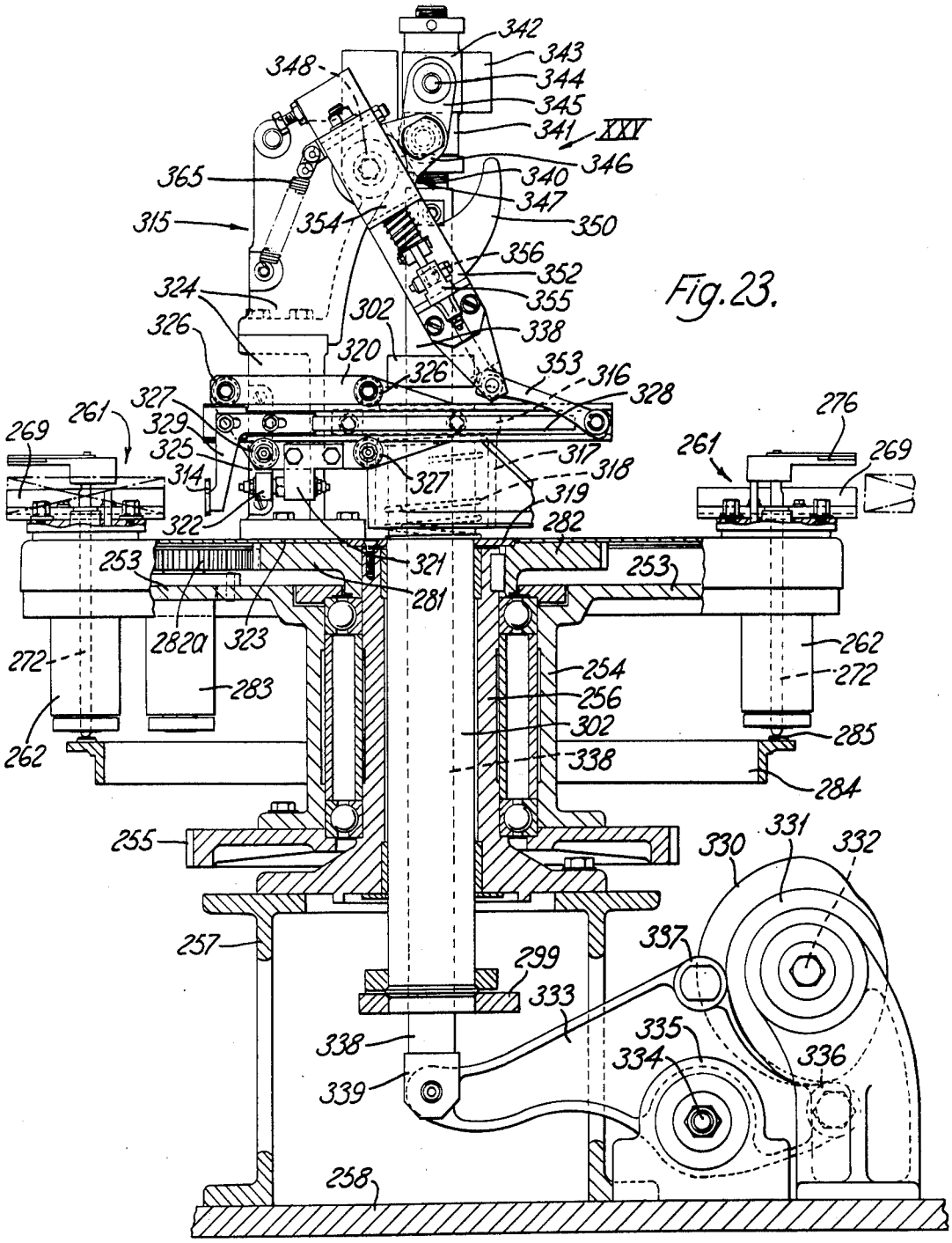
Figure 24:
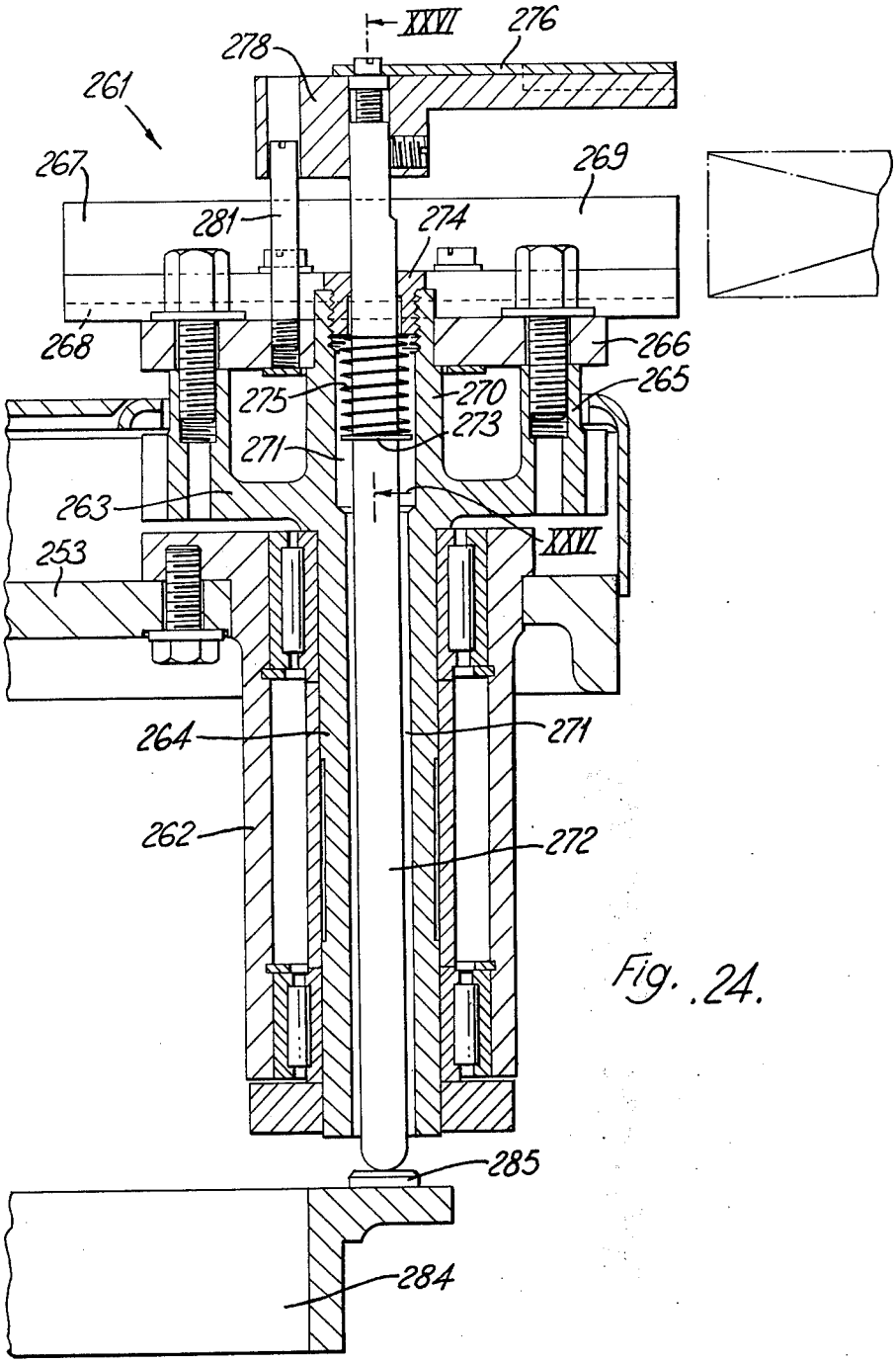
Figure 25:
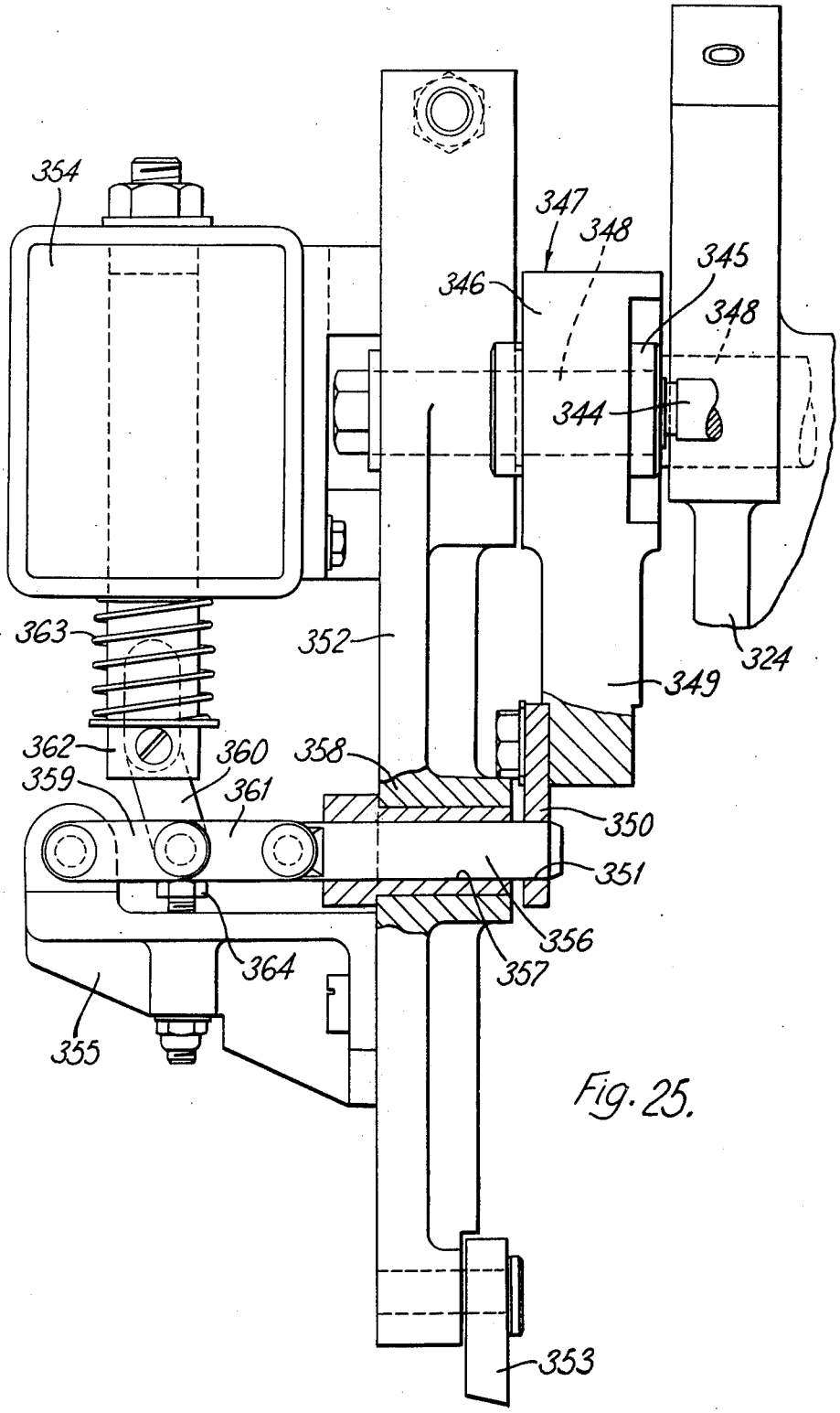
Figure 26:
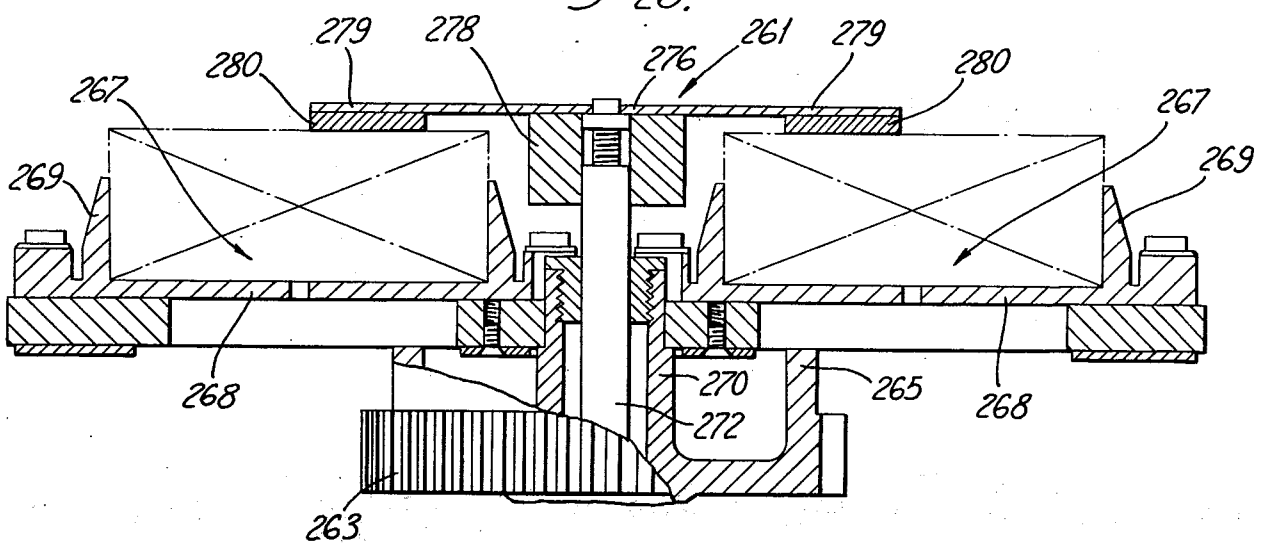
Figure 27:
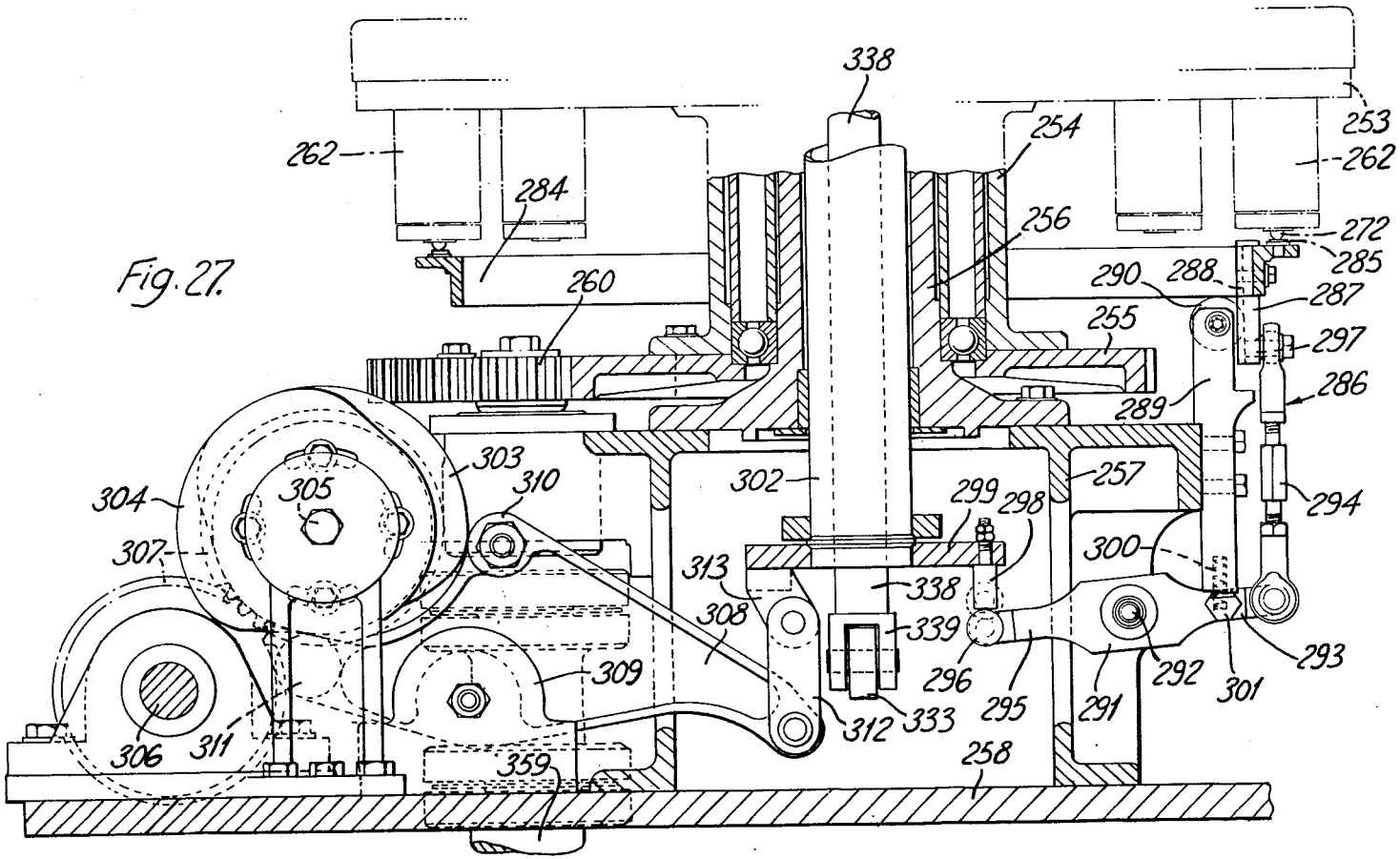
Figure 28:
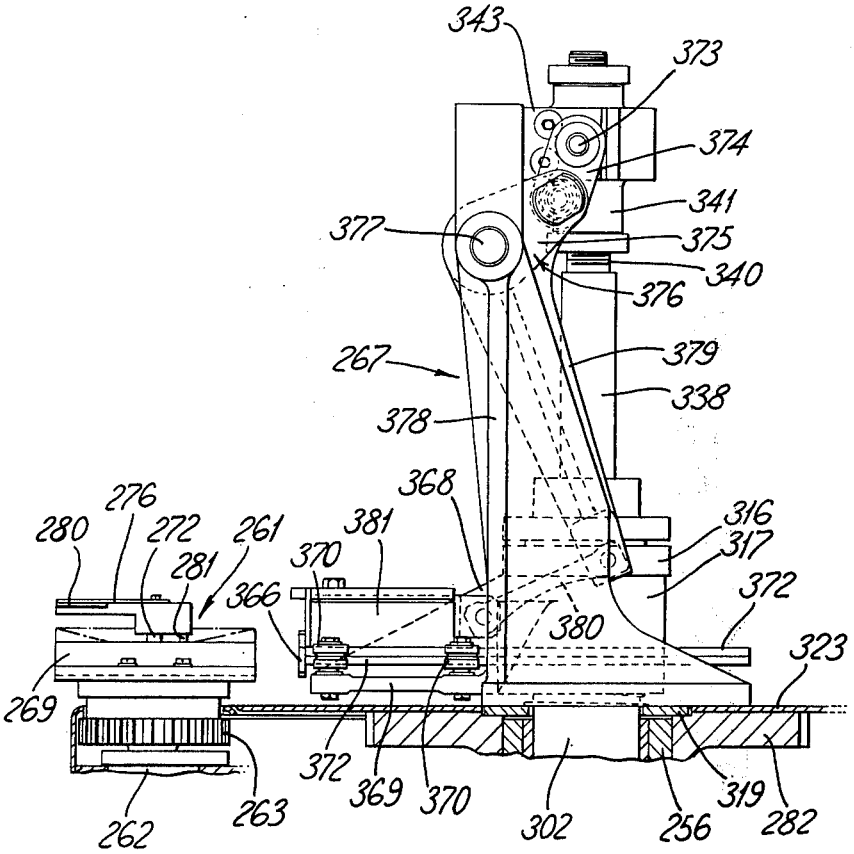

The invention will now be described, by way of example only, with reference to the accompanying drawings in which:

FIG. 1 is a diagrammatic plan view of a preferred layout of machine for forming bundles of cigarettes and wrapping them in metallic foil, FIG. 2 is a view taken on the line II—II of FIG. 1, FIG. 3 is a side view of FIG. 1 taken in the direction of arrow III of FIG. 1, FIG. 4 is a plan view of apparatus for ejecting bundles of cigarettes from a pocketed conveyor, FIG. 5 is a section taken on the line V—V of FIG. 4, FIGS. 6 and 6A together show a side view, partly in section, of apparatus for compressing bundles of cigarettes and partly wrapping the compressed bundles in metallic foil, FIG. 7 is a detail of part of the apparatus of FIG. 6, FIG. 8 is a section on the line VIII—VIII of FIG. 6, FIG. 9 is a front elevation of apparatus for forming an overlap between two pieces of metallic foil, FIG. 10 is a view, partly in section, taken on the line X—X of FIG. 9, FIG. 11 is a section on the line XI—XI of FIG. 10, with some parts added, FIG. 12 is a side elevation, taken in the direction of arrow XII of FIG. 9, of apparatus for conveying overlapped pieces of metallic foil, FIGS. 13 and 13A together show a front elevation of apparatus for completing the wrapping of bundles of cigarettes, started by the apparatus of FIG. 6, FIGS. 14 and 14A together show a plan view of FIGS. 13, 13A, FIG. 15 is a section taken on the line XV—XV of FIG. 13, FIGS. 16 to 20 are perspective views showing successive stages in wrapping a bundle of cigarettes in metallic foil, FIG. 21 is a section on the line XXI—XXI of FIG. 13, FIG. 22 is a front view, partly in section of part of the apparatus of FIG. 3, taken on the line XXII—XXII of that Figure, showing additional parts and drawn to a larger scale, FIG. 23 is a section on the line XXIII—XXIII of FIG. 1, but showing more detail and drawn to a larger scale, FIG. 24 is a sectional view of part of the apparatus of FIG. 23 drawn to a larger scale, FIG. 25 is a view of part of the apparatus of FIG. 23 looking in the direction of arrow XXV of that Figure, FIG. 26 is a section on the line XXVI—XXVI of FIG. 24, FIG. 27 is a part section on the line XXVII—XXVII of FIG. 1, but showing more detail and drawn to a larger scale, FIG. 28 is a view looking in the direction of arrow XXVIII of FIG. 1 but showing more detail and drawn to a larger scale.

Referring to FIGS. 1, 2 and 3, the machine comprises basically the following units; a cigarette hopper CH, a cigarette bundle conveyor BC, a metllic foil feeding assembly FF which includes foil conveyor FC, a cigarette compression device CD, a foil folding and tucking unit FT, a bundle transfer unit TU and a bundle orientation and ejection unit EU.

BUNDLE CONVEYOR

Bundles of 20 cigarettes are formed, in known manner, in the hopper CH which may be of any convenient construction and is positioned so that the bundles may be removed therefrom two at a time, at positions P1, P2, FIG. 2, by two pushers 1, FIG. 3, only one of which is visible in the drawings, and fed onto the bundle conveyor BC. The latter comprises an endless conveyor band 2 which extends between two pulleys 3, 4 fixed to shafts 5, 6 respectively. The shaft 5, and thus also the conveyor 2, are driven intermittently, in the direction of arrow A, FIG. 2, by a motor, diagrammatically shown in FIG. 2 at 7, via a reduction gear box 8 and an indexing gear box 9 of any convenient known type having a continuously rotatable input shaft and an intermittently rotatable output shaft, the latter being connected to the shaft 5. Mounted on the conveyor band 2 are a plurality of hollow, open-ended pockets 10, the arrangement being such that each time the conveyor band 2 comes to rest, two consecutive pockets 10 are aligned, at positions P1, P2, with the pushers 1 which are then operated by cams (not shown) to push two bundles of cigarettes from the hopper CH into the waiting pockets 10. The conveyor band 2 is driven so that on each intermittent movement the pockets 10 are moved two pitches. Thus as the pockets are moved to the left (FIGS. 1, 2) away from positions P1, P2 all the pockets will contain a bundle of cigarettes.

Each time that the band 2 comes to rest the bundles of cigarettes at positions P3, P4 are aligned with two devices 11, FIG. 1, of any convenient known form, which are moved into engagement with one end of the cigarettes so as to test the firmness of one end of the cigarettes. Also the devices 11 may be used to test that the bundle contains the desired number of cigarettes. At the same time the bundles of cigarettes at positions P5, P6 are aligned with two further devices 11 which test the firmness of the opposite end of the cigarettes to that tested at positions P3, P4. Simultaneously, whilst the band 2 is at rest, the two bundles of cigarettes contained in the pockets 10 at positions P7, P8 are ejected, by two pushers 12, from their respective pockets and pushed through guide members 13 into two compression boxes 14, as will now be described with reference to FIGS. 4 and 5, the boxes 14 forming part of the compression device CD which will be described in detail later.

The pushers 12 are spaced apart by three pocket pitches, which arrangement, during normal operation of the machine, ensures that, as the pockets are moved further to the left, away from position P7, none of them will contain a bundle of cigarettes.

As the construction and operation of both pushers 12 are identical only one will be described, but reference numerals will be applied to both in the drawings. The pusher 12 is operated by a cam 15 fixed to a shaft 16 which is driven continuously from the motor 7, FIG. 2. The cam 15 engages a follower 17 carried on a lever 18, one end of which is pivotally connected at 19 to a fixed part of the machine, and the other end of which is connected to one end of a link 20. The outer end of the link 20 is pivotally connected to a block fixed to the underside of a plate 21. Also fixed to the plate 21 is an extension piece 22 which carries an arm 23 to which the pusher 12 is fixed, at the left hand end thereof, as viewed in FIG. 4. To constrain the pusher 12 to move in a straight line as it is reciprocated by the cam 15 the plate 21 carries four freely rotatable rollers 24 which engage a guide plate 25 mounted on a block 26 which in turn is carried on a fixed plate 27. Thus, after each forward stroke (i.e., to the left in FIGS. 4 and 5) of the two pushers 12, a bundle of cigarettes will have been inserted into each of the compression boxes 14.

SOFT ENDS DETECTOR

If a defect is detected in any one of the bundles of cigarettes (e.g. a cigarette with soft ends or an incomplete bundle) by one of the devices 11, it may be desirable to eject that bundle from the conveyor band 2 beyond the position P7. To allow this to be done, when the defective bundle comes to rest at either of the positions P7, P8, the aligned pusher 12 must be prevented from operating to eject the bundle from its pocket 10. For this purpose the lever 18 is provided with a pin 28 which engages in a recess 29 formed in an arm 30. The latter is pivotally mounted at 31 to a bracket 32 fixed to the underside of the plate 27. A short link 33 is connected at one end to the arm 30 and at the other end to the core of a solenoid 34. A spring 35 extends between the core of the solenoid and a pin fixed to the bracket 32. The arrangement is such that all the time acceptable bundles of cigarettes are carried to the position P7, in the pockets 10, the arm 30 is held by the springs 35 in the position shown in FIG. 5 in full line so that the pusher 12 is free to operate as described above, to eject the bundle from the pocket. If, however, a defective bundle is detected by one of the devices 11, a signal is fed, via a delay device (not shown), to the solenoid 34 which is energised and the arm 30 swung downwards, about the pivot 31, so that the recess 29 drops over the pin 28, as shown in chain-dot line in FIG. 5 and operation of the pusher 12 is prevented. The delay device referred to above may be of any convenient known form. The other pusher 12 is also prevented, at appropriate times, from removing defective bundles from pockets 10 at the position P8. A further pusher 36 may be provided at position P9, FIGS. 2 and 3, to eject defective bundles from the pockets 10 into a waste box (not shown).

INITIAL BUNDLE WRAPPING

After a bundle of cigarettes has been pushed into each of the compression boxes 14, as described above, the bundles are slightly compressed to a predetermined size whilst being moved downwards into the path of a pair of chain conveyors 3 (FIGS. 1, 6 and 7). The apparatus for performing these operations, shown at CD, in FIG. 3, will now be described with reference to FIGS. 6, 6A and 7. As both compression boxes 14 are identical only one will be described but, as with the description of pushers 12, reference numerals will be applied to both boxes in the drawings.

The apparatus comprises a base plate 38, on which the guide members 13 are supported, in alignment with the pushers 12, by posts 39 fixed to the plate 38. Extending nearly across the whole width of the machine, FIG. 8, is a pair of beams 40, joined by two cross pieces 41 each having two extensions 41*a*, which depend downwardly therefrom. Between each pair of cross pieces 41, 41*a* is a compression box 14 as will be described later. Fixed to the middle, as viewed in FIG. 8, of the beams 40 and extending vertically downwardly therefrom, is a guide rail 42, the latter being movable vertically between two pairs of rollers 43, 44, rotatably mounted on a fixed plate 45.

The guide rail 42 is moved up and down by a cam 46, FIG. 6A, fixed on a shaft 47 which is driven continuously from the motor 7. The cam 46 engages a follower 48 carried on a lever 49 one end of which is pivotally connected at 50 to a fixed part of the machine, and the other end of which is connected to the lower end of a connecting rod 51. The upper end of the rod 51 is connected, at 52, to the guide rail 42, FIG. 6.

The compression box 14 comprises a fixed bottom wall 53 having a slot 53*a*, FIG. 8, which extends along its whole length (the dimension viewed in FIG. 6), a movable top wall 54, and two side walls 55, 56. The top wall 54 has two studs 57 fixed to it which slide in holes in the cross piece 41, the wall 54 being resiliently urged upwards by springs (not shown). A bell crank lever 58 is pivoted at 59 to the cross piece 41, one arm of the lever carrying a roller 60 which engages the top surface of the top wall 54, and the other arm carrying a cam follower 61 which engages a fixed cam plate 62. The side walls 55, 56 each have studs 63 which slide in holes in one of the extensions 41*a*, the sides being resiliently urged away from each other by springs (not shown). A plate 64, also pivoted at 59 carries a roller 65, which engages side walls 55, and a cam follower 66 which engages a further fixed cam plate 67. The other side wall 56 is engaged by a roller 65*a* carried on a plate 64*a*, which is pivoted at 59*a* to the cross piece 41, and which also carries a cam roller 66*a* which engages a fixed cam plate 67*a*.

The cam plates 62, 67, 67*a* are so shaped and positioned that, as the guide rail 42 is moved downwards, on rotation of the cam 46, first the plates 64, 64*a* are swung about their respective pivots 59, 59*a*, which causes the side walls 55, 56 to be moved towards each other; and then the lever 58 is swung about the pivot 59 which causes the top wall 54 to be moved downwards, the combined movements of the walls 54, 55, 56 serving to reduce the cross-sectional dimensions of the bundle of cigarettes to a predetermined size. The compression boxes 14 are moved downwards until they reach the position shown in chain-dot lines in FIG. 6, at which time the two bundles of cigarettes are positioned in the path of travel of two pushers 68, carried on the chain conveyors 37.

The pushers 68 push the bundles of cigarettes into and through the foil folding and tucking unit FT during which movement each bundle is wrapped in metallic foil. Before describing the unit FT in detail, the foil feeding assembly FF and foil conveyors FC will be described with added reference to FIG. 9, 10, 11 and 12.

FOIL FEEDING ASSEMBLY

The foil feeding assembly FF includes three pairs of rollers, FIG. 2, which are driven continuously, from the motor 7, to feed a continuous web of metallic foil from a reel 69 (FIG. 1) towards a feed drum 70, and also includes conventional means for cutting the foil into discrete pieces; the cuts effected are first, a cut lengthwise of the foil web by a longitudinal cutter 70*A* and secondly, repeated cuts transversely of the web at regular intervals by a cross-cutter 70*B*. The drum 70 accordingly receives foil as a succession of pairs of pieces; the longitudinal cutting (often termed slitting) of the web is effected at some distance from the centre line of the foil web, hence the foil pieces of each pair are of different size. The larger piece is to serve as the principle inner wrapping of the cigarettes, while the smaller piece is to serve as the "loose front foil" commonly provided to enclose the ends of the cigarettes adjacent to the lid of their packet so as to be readily removed and discarded when the packet is open. The drum 70 has a slightly higher peripheral speed than the speed at which the web is pulled from the reel 69, thus giving a small spacing between successive pairs of foil pieces.

The drum 70 is a suction drum, i.e., it has ports in its circumference communicating via internal passages and conventional connecting devices with a suction source (not shown) so that the foil pieces fed to the drum 70 are retained thereon by atmospheric pressure while they are required to travel with the drum, said passages and connection including valve means to disconnect the suction source from each port as the latter reaches a position at which a foil piece is to be released from the drum.

Two transfer drums 71, 72 are disposed diametrically opposite each other adjacent to and each form a nip with the feed drum 70, the drums 71, 72 also being suction drums and are provided with a number of spaced circumferential grooves 73, FIG. 9. Although the drums 71, 72 are shown as being at diametrically opposite positions about the drum 70, they may of course, be disposed at any suitable position about the drum 70. Also, by using different sizes of drums 71, 72 the pieces of foil may be fed to the carrier plates 74, 75 respectively at different pitches. Below each of the drums 71, 72 is a carrier plate 74, 75 respectively, each of the carrier plates being inclined downwardly and to the left, as seen in FIG. 2, and serves to guide foil pieces from the associated transfer drum 71, 72 to foil conveyors 76, 77 respectively, these conveyors being of the endless belt type. As the carrier plates 74, 75 are identical in construction and operation, as are the foil conveyors 76, 77 only the carrier plate 75 and conveyor 77 will be described.

The carrier plate 75 consists of a block 78 which is rotatably carried on a fixed hollow shaft 79 connected to a source of suction (not shown), the plate 75 being oscillated about the axis of the shaft 79 by cam means (not shown). The block 78 has a first body member 80 fixed to it which has a number of finger-like projections 81, FIG. 10, extending therefrom. The member 80 has two pairs 82 of freely rotatable rollers mounted on its upper surface, and a slide 83 is arranged to be reciprocated between the pairs of rollers 82. The slide 83 extends to the right, as viewed in FIG. 10, beyond the main body member 80 and a second, and smaller body member 84 is fixed to the slide 83, the member 84 having finger-like projections 81*a*, similar to the projections 81, extending therefrom. Carried on the right hand end, FIG. 10, of the slide 83 is a cam follower 85 which is arranged to run in an arcuate cam track 86, formed in a bracket 87 attached to a fixed part of the machine.

Five elongated holes 88 are formed in the member 80, each hole having a flexible flap 89, fixed at one end thereof to the member 80, and which extends over part of the length of its associated hole, as seen in FIG. 10. Carried on the underside of each of the flaps 89, and extending into the holes 88, is a block 90 having a lip 91. The flaps 89 have two slots 92, FIG. 10, formed in them so that the blocks 90 may be clamped in any chosen position within the limits of the length of the slots 92. The second body member 84 is provided with a single elongated hole 88*a*, flap 89*a* provided with slots 92*a* and a block 90*a* having a lip 91*a*.

Formed in the first body member 80 are six suction chambers 93 all of which communicate with a manifold 94, the latter, in turn connecting with two ducts 95. Suction ports 96 are provided in the lower surface of the member 80, which communicate with the suction chambers 93. The hollow shaft 79 is provided with two radial holes 97 which at appropriate times, as will be described later, serve to connect the ducts 95, and thus the ports 96, with the source of suction. The second body member 84 is provided with suction ports 96*a* which communicate with two suction chambers 93*a*, the latter being connected to a manifold 98 formed in a block 99, fixed on the slide 83, the manifold 98 being connected to the manifold 94 by means of a flexible pipe 100 and a passage formed in a block 101 fixed on the member 80. Thus, as suction is applied to the ports 96 in the first body member 80, it is simultaneously applied to the ports 96*a* of the second body member 84.

The foil conveyor 77 comprises a foraminous band which passes round a series of rollers 102, 103, 104, 105, 106, FIG. 12, and a roller 107, FIG. 6. The conveyor 77 is driven intermittently in a clockwise direction, as viewed in FIG. 12, from the motor 7 via an indexing gear box 108, FIG. 6A, similar to the gear box 9, and the output shaft of which drives gears 109, 110, and a shaft 111, FIGS. 6A, 6 and 12 which, in turn, drives the roller 105 through bevel gears (not shown). The rollers 102–107 are so arranged that between the rollers 102, 103 the conveyor 77 runs in a horizontal plane, and between the rollers 103, 107 it runs in a vertical plane. Suction chambers 119, 120 respectively are provided adjacent the horizontal and vertical runs of the conveyor 77, and the roller 103 is so constructed that suction is applied through the conveyor 77 as it passes over the roller 103. Positioned just below the roller 107 is a plate 112 attached to an arm 113 fixed to a pivot pin 114 journalled in a fixed part of the machine. Also fixed to the pin 114 is a cranked arm 115, FIGS. 6, 12 carrying a cam follower 116 which engages a cam 117 driven continuously from the motor 7, the follower 116 being held against the cam 117 by a spring 118. Mounted adjacent to the conveyor 77 so that part of it runs in a vertical plane close to the vertical run of the latter, is a further conveyor comprising an endless band 121 which passes over a number of guide rollers 122 and a drive roller 123, fixed on a shaft 124. The roller 123, and thus the band 121, is driven intermittently from the gear 109 by a further gear 125, a shaft 126, bevel gears 127 (FIG. 7), a gear train 128 and a gear 129 fixed to the shaft 124.

FOIL FEEDING OPERATION

In operation the pairs of foil pieces delivered to the drum 70 travel round with the drum as the latter rotates continuously, and are transferred to either the drum 71 or the drum 72. The drum 70 rotates anticlockwise (as seen in FIG. 2) hence each pair of foil pieces first reaches drum 71 but valves are provided and operated so that suction is connected to the latter drum only intermittently, at such times that alternate pairs of foil pieces reach the nip between the drum 70 and the drum 71 at times when the latter is not connected to suction and hence these pairs of foil pieces remain on drum 70 until they reach its nip with drum 72. The drum 72 also has suction applied to it intermittently, at times synchronised with the arrival of foil pieces so as to remove the latter from drum 70. The application of suction to drum 71 is timed to coincide with the arrival of the intermediate pairs of foil pieces at the nip between drums 70 and 71 so that these pairs are removed from drum 70 by drum 71.

The internal suction connections and valve means of drum 70 are arranged to release the pairs of foil pieces as they come to the nips where they are to be transferred to drums 71, 72. Thus a regular succession of pairs of foil pieces are fed round the drum 70 and equally and regularly transferred to the drums 71, 72 and thence fed to the carrier plates 74, 75 respectively.

As a pair of pieces of foil travels round with the drum 72 the carrier plate 75 is in the position shown in FIG. 11, with the fingers **81, 81*a* positioned in the circumferential grooves 73, and the body members 80, 84 being spaced slightly apart as shown in FIG. 12. However, the pieces of foil are still in contact with each other even though they are not joined, so the piece of foil held on the body member 84 extends beyond the left hand edge, as viewed in FIG. 12, of that body member. With the plate 75 in this position the ducts 95 are in communication with the holes 97, and this suction is applied through the ports 96, 96*a* to hold the pieces of foil against the lower surface of the plate 75, the suction being sufficient to hold the foil against the surface of the plate without preventing movement of the foil downwardly over the surface. The pieces of foil continue to move over the plate 75 until their leading edges contact the lips 91, 91*a*** which are positioned according to the size of the pieces of foil being fed.

After the pieces of foil have come to rest against the lips **91, 91*a* the plate 75 is rotated about the shaft 79 in a clockwise direction. As this movement is taking place and due to the follower 85 running along the cam track 86, the slide 83, and thus the second body member 84, is caused to move to the left. Due to the concave shape of the piece of foil held on the body member 84, the edge portion of that piece of foil will lie in a slightly different plane from the adjacent edge of the other piece of foil held on the body member 80, thus permitting overlapping of the two foil pieces to occur without edges of the foil pieces abutting. Alternatively the edge portion of one of the body members 80, 84 could be chamfered and suction ports provided in the chamfered edge portion or, the lower surface of one of the body members could be arranged to be at a slightly different level to the other. In each case however, the overlap is formed by moving the body member 84** as described above.

The rotational movement of the plate 75 continues until the now overlapped pieces of foil contact the foil conveyor 77, at which time it stops. Just prior to the plate 75 coming to rest, the lips **91, 91*a* engage the conveyor 77 which causes the flaps 89, 89*a* to bend, as shown in FIG. 9, and the lips moved out of engagement with the pieces of foil. By the time the plate 75 comes to rest in the position shown in FIG. 9, the ducts 95 are no longer in communication with the holes 97, thus cutting off the suction from the ports 96, 96*a*. However, as suction is applied continuously to the conveyor 77, the pieces of foil will be held against it. The plate 75 is then returned to the position shown in FIG. 11, ready to receive a further pair of pieces of foil and during this movement the body member 84 is moved back to the position shown in FIG. 12**.

The foil conveyor is then driven so as to convey the overlapped pieces of foil horizontally, then round the roller 103 and then vertically downwards until the middle part of the overall length of the overlapped pieces of foil is opposite the bundle of cigarettes positioned in the compression box 14, previously described with reference to FIGS. 6 and 8. When in the last described position, the lower half of the foil extends below the base plate 38 through a hole **38*a* formed therein. Feeding of the foil downwardly is assisted by the vertical run of the endless band 121, and during this movement the plate 112 is clear of the path of travel of the foil. At the same time, of course, another pair of pieces of foil is fed to a position opposite the other compression box 14 from the transfer drum 71 by the carrier plate 74 and foil conveyor 76** in the same way as described above.

It will thus be seen that with the apparatus described above both of the foil conveyors 76, 77 are supplied with a succession of pieces of foil which are cut from a single continuous web of foil.

FOIL FOLDING WRAPPING

The two bundles of cigarettes contained in the compression boxes 14 are pushed to the left, as viewed in FIG. 6, by the pushers 68 into and through the foil folding and tucking unit FT which will now be described with reference to FIGS. 6, 16, 17 and 18. The wrapping of only one of the bundles of cigarettes will be described, but it is to be understood that both bundles are, in fact, wrapped at the same time in an identical manner.

At the same time as the foil conveyors 76, 77 and endless band 121 start to move, as described previously, the chain conveyor 37 also starts to move. The conveyor 37 comprises a pair of endless spaced chains 130, only one of which is visible in the drawings, which extend between sprockets 131, 132 fixed to shafts 133, 134 respectively. The shaft 134, and thus the chains 130, are driven in an anti-clockwise direction, as viewed in FIG. 6, from the shaft 126 by a pair of bevel gears 135, 136, the latter being fixed to a stub shaft 137 which also has a gear 138 fixed to it. The gear 138, in turn, drives a gear 139 which is fixed to the shaft 134. Three pushers 68, equispaced around the chains 130, are each pivotally carried at 140 between a pair of plates 141, the latter being fixed to the chins 130. The pushers 68 are of the well known "tip back" type, and each have a block 142 arranged to run on a pair of fixed tracks 143, only one being visible in FIG. 6, which extend along the upper runs of the chains 130 so that the pushers 68 are held in an attitude such that they can engage the rear faces of the bundles of cigarettes. Two of the pushers 68 are shown in this attitude in FIG. 6.

Figure 16:
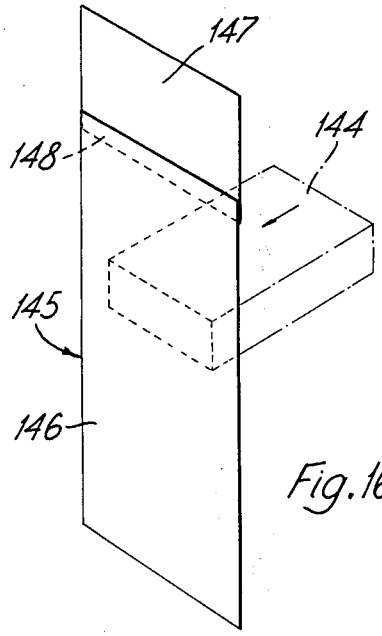
Figure 17:
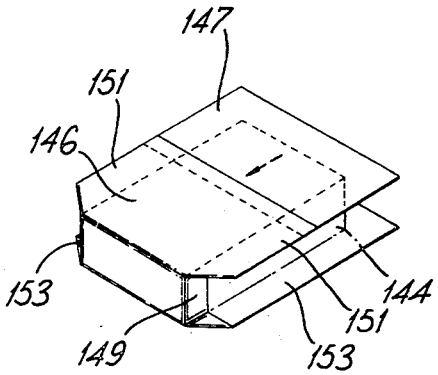

The timing of the movement of the pieces of foil and the bundle of cigarettes is so arranged that as the foil reaches the position, described earlier, opposite the bundle of cigarettes, the bundle of cigarettes is pushed, by the pusher 68, horizontally against the foil. A bundle of cigarettes 144 and a composite piece of foil 145, which extends beyond each side of the bundle, are shown in this position in FIG. 16, the foil consisting of a large piece 146 and a smaller piece 147, the two pieces being overlapped at 148 as described previously with reference to FIGS. 9, 10 and 11. On continued movement of the pusher 68 to foil is moved into contact with the endless band 121 and the top surface of the base plate 38, which combine to constrain the foil to assume a U-formation partly enclosing the bundle 144, the ends of the pieces of foil both extending beyond the rear end of the bundle, and the small end tucks 149, on both sides of the bundle 144, are folded, as shown in FIG. 16, by fixed folders 150, FIG. 6. To assist in guiding the leading edge, considered in its direction of movement, of the smaller piece of foil 147 round the bottom right hand roller 122, as viewed in FIG. 6, the plate 112 is moved to the left, at the appropriate time, by the cam 117.

As the bundle 144 is pushed further to the left, the top side flaps 151 are folded down into contact with the sides of the bundle 14 by plough folders 152, and the bottom side flaps 153 are folded up to contact the flaps 151, by further plough folders 154.

Figure 18:
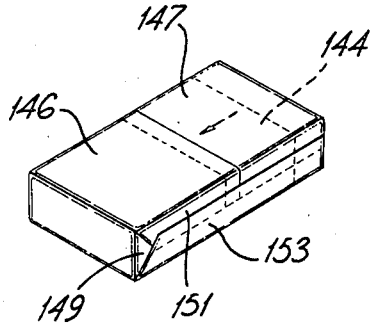

The partially wrapped bundle, which is now as shown in FIG. 18, comes to rest as the block 142 runs off the left hand end, as viewed in FIG. 6, of the fixed track 143, which causes the pusher 68 to tip clockwise about the pivot 140 and move out of engagement with the rear face of the bundle 144. The conveyor 37, foil conveyor 77 and endless band 121 are then brought to rest ready for the next cycle of operations, to wrap a further bundle of cigarettes in foil.

COMPLETION OF BUNDLE WRAPPING

At this stage of the operation of the machine, two bundless of cigarettes, partially wrapped in foil, are stationary at the positions shown at P10, FIG. 1. The apparatus for completing the wrapping of the foil about the bundles of cigarettes will now be described with added reference to FIGS. 13, 13A, 14, 14A, 15 and 19 to 21. The completion of the wrapping of the foil about the two bundles of cigarettes is performed by two separate apparatuses AP1 and AP2 which are similar but one is the mirror image of the other. Only the apparatus AP1 will be described but the reference numerals will also be inserted on the apparatus AP2 in FIG. 13A.

Immediately prior to reaching the position P10, as described above, the partially wrapped bundle passes on to a base plate 155 which forms a continuation of the base plate 38. Fixed on the top of the latter is a channel 156 which extends to the left, FIG. 15, from the end of the plough folder 154, FIG. 6, and comprises two side walls 157 and a top wall 158, the side walls 157 each being provided with two slots 159. The base plate 155 has two downward facing lugs 160, 161, and fixed respectively to the lugs is a side plate 162, 163. Fixed to the side plate 162 is a bracket 164 which has a horizontal guide rail 165 fixed to it. A plate 166 carries two pairs 167, 168 of rollers which engage opposite sides of the guide rail 165. Two bosses 169 extend upwardly, through elongated solts 250, FIGS. 14, 14A, in the base plate 155, from the plate 166, each having a freely rotatable shaft 170, 170*a* respectively passing through it. The top of each shaft 170, 170*a* has a tucker 171, 171*a* fixed to it, the latter each being provided with a pair of vertically spaced prongs 172 which are arranged to pass through the slots 159 in the side walls 157 as will be described later. In order that the tuckers 171 may move in unison, the shafts 170 are drivingly interconnected by two toothed quadrants 178, fixed to the shafts 170, 170*a*.

A further boss 173, which extends downwardly from the plate 166, has a shaft 174 rotatably mounted therein fixed to which is one end of a short arm 175, the other end of the latter carrying a roller 176 which runs in a U-shaped guide channel 177. One end of a lever 179 is pivotally connected to the arm 175, between the shaft 174 and the roller 176, and the other end is fixed to the bottom end of the shaft 170, which extends below a quadrant 178 fixed to it. Rotatably carried in the bracket 164 are two vertical shafts 180. Fixed to the other end of each of the latter is one end of a link 181, the other end of each of the links 181 being pivotally connected to the bottom surface of the guide channel 177 near the opposite ends thereof, FIG. 15. Fixed to the lower end of each of the shafts 180 is a further link 182, the links 182 being connected at equal distances from the axes of the shafts 180, by an arm 183. The right hand link 182, as viewed in FIG. 15, carries a roller 184 which runs in a cam slot 185 formed in the periphery of a box cam 186. The cam 186 is fixed on a cross shaft 187, which is common to both the apparatuses AP1, AP2, and extends through, and is journalled in, both side plates 162 and both side plates 163. The shaft 187 is driven continuously via further gears 188 and bevel gears 189, from a drive shaft 190 which, in turn, is driven from the motor 7.

After the bundle comes to rest at position P10, rotation of the cam 186 causes, through links 182 and arm 183, the shafts 180 to rotate which, in turn, through links 181, move the guide channel 177 bodily sideways, without changing its attitude, so that at all times the roller 176 is capable of being moved to and fro along the guide channel 177 as will be described later. This movement of the guide channel causes the arm 175 to swing about the axis of the shaft 174 and, through lever 179, rotates the shaft 170 and thus the tucker 171. The tucker 171*a* is also rotated at the same time, but in the opposite direction, through the quadrants 178. The tuckers 171, 171*a* are rotated, as just described, so that their respective prongs 172 pass through the slots 159 in the side walls 157 and fold the small end tucks 191, on both sides of the bundle 144, as shown in FIG. 18. After folding the tucks 191, the bundle is moved further along the channel 156, by the tuckers 171, 171*a*, to a position indicated at P12 in FIG. 1, the tuckers 171, 171*a* then being swung outwardly, by reason of the guide channel 177 being returned to its original position by further rotation of the cam 186. The tuckers 171, 171*a* are then moved back to the position shown in FIG. 15 and the sequence of operations described above is repeated on the next bundle of cigarettes to be fed to the position P10.

The tuckers 171, 171*a* are moved to and fro by a cam 192, fixed on the shaft 187, and which is engaged by a cam follower 193 carried on an arm 194 which is freely mounted, at one end thereof, on a further cross shaft 195 which, like the shaft 187, is common to both the apparatuses AP1, AP2. The other end of the arm 194 is pivotally connected to one end of a short link 195. The other end of the latter is connected to a lug 196 fixed to the underside of the plate 166. The arrangement is such that as the tuckers 171, 171*a* are moved to the left, FIG. 15, by rotation of the cam 192, the roller 176 runs along the guide channel 177 and the prongs 172 are maintained in the position in which they engage the bundle, i.e. they extend into the channel 156, and as the tuckers return, the prongs 172 are maintained in the position in which they are retracted from the channel 156.

As the prongs 172 are being retracted through the slots 159, the bottom rear flap 197, FIG. 19, is folded up, to contact the rear face of the bundle 144, as shown in FIG. 20, by a folder 198 which is moved upwards through a slot (not shown) in the base plate 155. The folder 198 is fixed to a shaft 199, which extends between, and is journalled in, the lug 161 and a further lug 200 fixed to the underside of the base plate 155. The folder 198 is moved up and down, about the axis of the shaft 199, by a cam 201 which is fixed on the shaft 187 and engaged by a cam follower 202 carried on a lever 203 fixed to a shaft 204. The latter extends through, and is journalled in, the side plates 162, 163 of the apparatus AP1 and side plate 163 of apparatus AP2. A short arm 205 is also fixed, at one end thereof, on the shaft 204, the other end being pivotally connected to the lower end of a connecting rod 205. A link 207 is pivotally connected at one end thereof to the upper end of the connecting rod 206 and is fixed at the other end to the shaft 199.

As the folder 198 is moved downwards, as described above, the rear top flap 208, FIG. 19, is folded down to contact the flap 197, as shown in FIG. 20, by a folder 209, so as to complete the wrapping of the foil about the bundle. The folder 209 is first moved downwardly, to effect folding of the flap 208, then to the left, as viewed in FIG. 21, which movement causes the wrapped bundle to be pushed out of the unit FT and into the bundle transfer unit TU, the folder 209 then being moved upwardly and then to the right, FIG. 21, and the sequence of operations, described above, is repeated on the next bundle to be fed to the position P12. To allow for movements of the folder 209, a slot 251 is formed in the top wall 158 of the channel 156.

It should be noted here that the folders 209 associated with both the apparatuses AP1, AP2 are connected to a common operating apparatus AP3, which is positioned between the two side plates 163, and will now be described with reference to FIGS. 13, 13A and 21.

Attached to a fixed part of the machine is a horizontal guide rail 210 along which a plate 211 is moved to and fro, the plate being guided along the rail 210 by two pairs 212, 213 of rollers which engage opposite sides of the rail, as seen in FIGS. 13, 13A. A shaft 214 is journalled in two spigots 215 fixed to the upper surface of the plate 211, and the folders 209 are fixed to opposite ends of the shaft 214. A stud shaft 216 is journalled in an extension piece 217 carried on the underside of the plate 211, the shafts 214, 211 being drivingly interconnected by means of a pair of toothed quadrants 218. Also fixed on the shaft 216 is one end of short link 219, the other end of which carries a roller 220 which runs in a further horizontal U-shaped guide channel 221 carried on a block 222. The block 222 carries two pairs 223, 224 of rollers, between which a fixed vertical guide rail 225 is positioned, the latter being supported from the side plate of the apparatus AP1. The block 222, and thus the guide channel 221, are moved vertically along the rail 225 by a cam 226 fixed on the shaft 187. A cam follower 227 engages the cam 226 and is carried on one end of a lever 228, the other end of which is pivotally connected to a spacer 229 fixed to the side plate 163 of the apparatus AP1. A short arm 230 is connected, at opposite ends thereof, to the lever 228 and the block 222. The arrangement is such that as the cam 226 rotates, the folders 209 will move up and down, about the axis of the shaft 214 by reason of the shaft 216 being oscillated by vertical movement of the guide channel 220.

The folders 209 are moved to and fro along the guide rail 210 by a cam 231 which is engaged by a cam follower 232 mounted on a lever 233, the latter being freely rotatably carried, at one end thereof, on the shaft 195. A link 234 is pivotally connected at opposite ends thereof to the other end of the lever 233 and a lug 235 attached to the underside of the plate 211, the lug 235 extending through a slot 252. The folders 209 are maintained in either of the lower or raised positions by means of roller 220 running along the guide channel 221 as the folders are moved by the cam 231.

On being pushed, from position P12, by the folders 209, as described above, the wrapped bundles come to rest, in the bundle transfer unit TU, at the positions shown at P13 in FIGS. 1 and 22. Whilst in the unit TU the two wrapped bundles are moved towards each other until they come to rest at the positions indicated at P14 in the FIGS. 1 and 22. The unit TU comprises two rotatable circular carriers 236, 237 driven intermittently in opposite directions, from the motor 7, via a gear box (not shown), which may be of the same type as the gear box 9 or, alternatively, a Geneva indexing mechanism of any convenient form. The drive from the gear box, mentioned above, to the carrier 236 is via a train of gears 238 and a gear 239, fixed to the carrier 236, carried on the shaft 240. Also carried on the shaft 240 is a sun gear 241, and fixed to three stub shafts 242 carried by the carrier 236, are three holders 243 equispaced round the carrier 236. A planet gear 244 is attached to each stub shaft 242 and an idler gear 245 is positioned between, and meshes with, the sun gear and each of the planet gears 244. The ratio of the various gears within the carrier 236 is such that, as the holders 243 are carried round, about the axis of the shaft 240, by the carrier 236, they are maintained in the same orientation i.e., so that the wrapped bundle of cigarettes, contained therein, is always horizontal. The other carrier 237 is rotated, but in a clockwise direction, as viewed in FIG. 22, by identical gearing to that just described in relation to the carrier 236, so will not be described. When the two holders 243 at the positions P13 come to rest at the positions P14, the bundles of wrapped cigarettes are in alignment with two pushers 246. The pushers 246 are each fixed to one end of a pair of bars 247, only one of which is visible in FIG. 21, the other end of both bars 247 being fixed to the upper surface of the plate 211. The arrangement is such, that as the plate 211 is moved to the left, FIG. 21 as described above, by the cam 231, the bundles at the positions P14 are pushed, by the pushers 246, out of their respective holders 243 into the bundle orientation and ejection unit EU, which briefly, comprises an indexing table IT, which rotates in steps in an anti-clockwise direction, as seen in FIG. 1. While on the table IT, each pair of bundles is brought into position to receive a pair of inner frames from a blank forming assembly BF (which cuts and folds card from the card supply reel CS to produce a succession of such frames). Further movement of the table IT brings each pair of bundles to a discharge position from which the foil wrapped bundles (each assembled with an inner frame) travel (as indicated by arrow T) towards another machine, such as that described and illustrated in the aforementioned co-pending application, in which the main body of a packet is formed around each bundle, but which forms no part of the present invention.

TURNTABLE

The unit EU will now be described in detail with reference to FIGS. 1 and 23 to 28. The table IT consists of a flat circular horizontal turnatable 253 formed with a central downwardly extending cylindrical casing 254 which is fixed at its bottom end to a large gear wheel 255. The casing 254 is co-axial with, and rotatably carried on, a vertical fixed hollow tube 256 which is bolted, at its lower end, to a box member 257 which, in turn, is fixed to a support frame 258. The turntable 253 is driven intermittently about the axis of the tube 256, in an anti-clockwise direction as viewed in FIG. 1, in 60° steps, from the motor 7 via an indexing gear box (not shown), which may be of the same type as the gear box 9, the output shaft 259 of the gear box having a gear 260 fixed to it which meshes with the large gear 255.

Carried on the turntable 253 and equi spaced round it, are six bundle carrying devices 261. Each device 261 consists of a housing 262 fixed to the turntable 253 and extending downwardly through a hole formed therein. Rotatably mounted in each housing 262 is a gear wheel 263 provided with a hub 264 which extends into the housing 262. The gear wheel 263 is also provided with an annular upward extension 265, to the upper end of which is bolted a plate 266. Attached to the top surface of the plate 266 are two pockets 267 each having a base 268 and two side walls 269.

A further hub 270 extends upwardly from the gear 263, and a bore 271 extends through both the hubs 264, 267. A push rod 272 is provided in the bore 271, so that it may be moved vertically, as will be described later, and a collar 273 is fixed onto the rod 272. A cap 274 is screwed into the top of the bore 271 and a compression spring 275 positioned between the bottom of the cap 274 and the collar 273. Fixed to the top of the push rod 272 is a clamp plate 276 provided with a central portion 278, which can pass between the pockets 267, and two wings 279 each of which extends over one of the pockets 267, and is provided with a resilient pad 280. Screwed into the plate 266 is a drive pin 281 which engages in a hole in the clamp plate 276.

Keyed to the tube 256, near its upper end, is a fixed gear wheel 282 and between each of the gear wheels 263 and the gear wheel 282 a further gear 282*a* is provided, the latter each being carried on a hub journalled on one of six further housings 283 fixed to the turntable 253. The arrangement is such that as the turntable 253 is rotated through each 60° step, as described above, each pair of pockets 267 is rotated, about the axis of the associated hubs 264, 267, in a clockwise direction, as viewed in FIG. 1, through the associated gear 263 being rotated by the meshing gear 282*a* as the latter rolls around the stationary gear wheel 282. The ratios of the various gears are such that each pair of pockets is rotated through 180° during each stepwise movement of the turntable 253. The pins 281 are provided so that the clamp plates 276 rotate in unison with the pockets 267.

Provided below the housing 262 is a large diameter ring 284 the upper surface of which is provided with six studs 285, only two of which are visible in the drawings, each of which engages the bottom of one of the push rods 272. The ring 284 is held in position by three support means 286, only one of which is visible in the drawings, which are equi-spaced around the ring. Each support means 286 comprises a block 287, fixed to the inside surface of the ring, and having a vertical groove 288 formed in it. Fixed to the box member 257 is a pillar 289 and rotatably carried at the top end of the pillar is a roller 290 which engages in the groove 288. A double arm lever 291, pivotally connected at 292 to a flange, formed as part of the box member 257, has one arm 293 connected at its end to the lower end of a connecting rod 294, and the other arm 295 carries a roller 296. The upper end of the connecting rod 294 is pivotally connected, at 297, to the block 287. The roller 296 engages the bottom of a post 298 carried on a plate 299, the roller 296 being kept in contact with the post 298 by a spring 300 which extends into recesses formed in the pillar 289 and a block 301 attached to the arm 293.

The plate 299 is fixed to the bottom end of an outer hollow column 302 which extends upwardly through the centre of the tube 356. The plate 299, and thus also the column 302, are moved vertically by a pair of cams 303, 304 fixed to a shaft 305, the latter being driven from a further shaft 306 by gears 307, the shaft 306, in turn, being driven continuously from the motor 7. An arm 308, pivotally connected to a bracket 309 fixed to the frame 258, carries two cam followers 310, 311 which engage the cams 303, 304 respectively, the arm 308 also being pivotally connected to one end of a short link 312. The other end of the latter is pivotally connected to a lug 313 fixed to the underside of the plate 299.

The arrangement is such that as the cams 303, 304 rotate the plate 299, column 302 and the three posts 298 are moved upwards which allows the three levers 291 to rock on their respective pivots 292 and, through the three rods 294 and blocks 287, the ring 284 will move vertically downwards and be guided by the three rollers 290 running in the groove 288. This movement of the ring 284 allows the six push rods 272, and thus also the clamp plates 276, to also move down. On continued rotation of the cams 303, 304 the plate 299 and column 302 moves downwards, thus causing the ring 284 and the clamp pins 276 to move upwards.

In operation, when the turntable 253 comes to rest, a bundle carrying device 261 is at the position indicated in FIG. 1 at P15, with its two pockets 267 in alignment with the two holders 243 at position P14, and its associated clamp plate 276 in the raised position, as shown in FIG. 23. The pushers 246 are then operated, as described above, to push the bundles of wrapped cigarettes, contained in the holders 243, into the pockets 267, and the clamp plate 276 is lowered to the position shown in FIG. 26 so that the bundles are engaged by the resilient pads 280 and prevented from moving in the pockets 267. The turntable 253 is then rotated, as described previously, through 60° and again comes to rest so that the device 261, containing the two bundles of cigarettes, is now at the position indicated in FIG. 1 at P16. The clamp plate 276 is raised and, if desired a coupon or the like e.g., having advertising matter printed on it, is fed onto each of the bundles of cigarettes from a mechanism CF which may be of any convenient known form. The clamp plate is lowered and the turntable rotated through a further 60° step and then brought to rest so that the device 261 in question, is at the position indicated in FIG. 1 at P17. The clamp plate 276 is raised and an inner frame is fed onto each of the bundles of cigarettes, from the blank forming assembly BF, as previously mentioned. The plate 276 is again lowered and the turntable rotated through a further 60° step to bring the device 261 being considered, to rest at the position indicated in FIG. 1 at P18. On coming to rest at this position the two wrapped bundles of cigarettes, in the pockets 267, are in alignment with two pushers 314 which form part of an ejection device 315 which will now be described in detail with reference to FIG. 23, 24 and 26. Although there are two pushers 314, they are of identical construction and operation, so only one will be described.

EJECTION DEVICE

Fixed to the outside of the outer hollow column 302, near the top end thereof, is a support bracket 316 which has a hollow cylindrical extension 317 depending downwardly therefrom, a compression spring 318, which surrounds the column 302, being provided between a flat ring 319 attached to the fixed gear wheel 282 and the upper end, as viewed in FIG. 23, of the extension 317. Fixed to the bracket 316 and extending to the left therefrom, as viewed in FIG. 23, is a plate 320 having a projection 321 fixed to it which carries a roller 322. Attached to a top plate 323, which is fixed to the gear wheel 282, is a support member 324 to which is fixed a pad 325 having a vertical surface which is engaged by the roller 322. Rotatably carried on the plate 320 are two pairs of rollers 326, 327 between which a guide rail 328 is moved horizontally, as will be described later. The guide rail 328 carries a crank arm 329 to which the pusher 314 is attached. It will thus be seen, as the column 302 is moved vertically by the cams 303, 304 as described previously the plate 320, guide rail 328 and pusher 314 will also move in the same manner, the roller 322 running up the pad 325 during this movement.

The guide rail 328 is moved horizontally between the pairs of rollers 326, 327 by a pair of cams 330, 331, FIG. 23, fixed to a shaft 332 which is driven continuously from the motor 7 by gearing (not shown). An arm 333, pivotally connected, at 334, to a bracket 335 fixed to the frame 258, carries two cam followers 336, 337 which engage the cams 330, 331 respectively. Passing co-axially through the outer hollow column 302 is an inner hollow column 338 having a bifrucated bracket 339 fixed to its bottom end, the arm 333 being pivotally connected to the bracket 339. The column 338 extends beyond the top of the outer column 302 and has a solid extension 340 attached to its upper end, FIG. 23. Carried on the extension 340 is a collar 341 provided with two radial projections 342, 343.

Loosely carried on a pivot pin 344, fixed in the projection 342, is one end of a link 345, the other end of which is connected to one arm 346 of a bell crank lever 347 rotatably mounted on a shaft 348 which is carried in the support member 324. The other arm 349 of the bell crank lever 347 has a curved plate 350 bolted to its free end, the plate 350 being provided with a hole 351, FIG. 25. Also rotatably mounted near one end thereof, on the shaft 348, is a long arm 352, and a link 353 is pivotally connected, at opposite ends thereof, to the other end of the arm 352 and the guide rail 328.

Carried on the arm 352 is a solenoid 354, and a bracket 355. A drive rod 356 is slidably mounted at 357 in a boss 358 formed on the arm 352. Three short links 359, 360, 361 are connected together at one end thereof, as shown in FIG. 25, the other end of the links being respectively connected to the bracket 355, a core 362 of the solenoid 354, and the left hand end, as viewed in FIG. 25, of the drive rod 356. A spring 363, under normal conditions, keeps the links 359, 360, 361, in the position shown, against an adjustable stop 364. In this position the drive rod extends in to the hole 351 in the curved plate 350 so as to provide a releasable connection between the bell crank lever 347 and the long arm 352, as will be explained later. To counterbalance the weight of the arm 352, when the drive rod 356 is withdrawn from the hole 351, a spring 365 is provided between the arm 352 and the support member 324.

In operation, when the device 261 being considered, comes to rest at position P18, FIG. 1, the two wrapped bundles of cigarettes contained therein are, as previously mentioned, in alignment with the two pushers 314, which are at this time in the position shown in FIG. 23. The clamp plates 276 are lifted and rotation of the cams 330, 331 causes the column 338 to move downwards which, through link 345 swings the bell crank levers 347 clockwise, as viewed in FIG. 23, about the axis of shaft 348. With the rod 356 engaged in the hole 351, the long arms 352 swing in unison with the bell crank levers, which movement moves the guide rails 328 and thus also the pushers 314 to the left, as viewed in FIG. 23, to push the two bundles from the pockets 267 towards a further machine (not shown) to be inserted into a packet. During this movement the pushers 314 pass rightthrough the pockets 267, and after they are clear of the latter, the clamp plates 276 are lowered and the turntable starts to rotate through a further 60° step. Whilst the turntable is moving, rotation of the cams 303, 304 causes the pushers 314 to be lifted above the level of the devices 261, then rotation of the cams 330, 331 cause the pushers to be moved to the right, FIG. 23, and continued rotation of the cams 303, 304 causes the pushers to be lowered so that they are again in the position shown in FIG. 23, and the sequence of operations described above is repeated as each successive device 261 comes to rest at position P18. All the time that acceptable wrapped bundles of cigarettes are being fed onto the unit EU, from position P14, each successive pair of bundles progresses stepwise through positions P15 to P18, and is then ejected, all as described above.

If a faulty bundle or pair of bundles of cigarettes is fed to the position P18 or, it is desired not to remove any acceptable bundle or pair of bundles from the machine e.g., for inspecton, at position P18, one, or both of the solenoids 354 is energised. This causes the core 362 of the energized solenoid or solenoids to move upwards, as viewed in FIG. 25, and, through links 359, 360, 361, the rod or rods 365 to be withdrawn from the hole or holes 351 in the curved plate or plates 350. With either or both rods 356 in such a position, the respective arm or arms 352 will not be operated to move the pusher or pushers 314 horizontally, as described above, even though the bell crank lever or levers 347 are still swung about the axis of the shaft 348, and the bundle or bundles will not be removed from their respective pocket or pockets 267. As soon as the rod or rods 356 are withdrawn from the hole or holes 351, the solenoid or solenoids 354 are de-energised, but the rod or rods 356 are prevented from moving to the right by the curved plate or plates 350, which continue moving with the lever or levers 247, until the hole or holes 351 are again aligned with the rod or rods 356 when the latter once more engage in the hole or holes 351 and the arm or arms 352 are reconnected to the lever or levers 347.

Any bundle or bundles, remaining in the pocket of a device 261, after the latter has moved away from the position P18, are carried two further 60° steps, by the turntable 253, and are brought to rest at the position indicated in FIG. 1 at P19. At this position the bundles contained in the device 261 are in alignment with two pushers 366 which form part of a rejection apparatus 367, which will now be described in detail with reference to FIG. 28.

As mentioned above, the apparatus 367 has two pushers 366 but, as these are identical in construction and operation, only one will be described.

Formed on extension 317 is a flange 368 which is provided with a horizontal portion 369. Rotatably carried on the portion 369 are two pairs of rollers, only one pair 370 of which is visible in the drawings. A guide rail 372, having the pusher 366 attached to its left hand end, as viewed in FIG. 28, is supported between the pairs of rollers, and is movable horizontally therebetween as will be described later. Rotatably mounted on a pivot pin 373, carried in the radial projection 343, is one end of a connecting link 374, the other end being pivotally connected to the free end of one arm 375 of a bell crank lever 376. The latter is pivotally carried, on a shaft 377, supported in a support bracket 378, fixed to the top plate 323. The free end of the other arm 379 of the bell crank lever 376 is connected to one end of a link 380, the other end of which is connected to a block 381 fixed to the top of the guide rail 372.

In operation, each time the turntable 253 comes to rest, so that the device 261 is at position P19, the pushers 366 are in the position shown in FIG. 28. The clamp plate 276 is lifted, and rotation of the cams 330, 331 causes both the pushers 366, as the collar 341 moves downwards, to move through the pocket 267 of the device 261, and push any wrapped bundles contained therein into a collecting device (not shown) which may be of any convenient form. The pushers 366 are then lifted, moved to the right, FIG. 28, and lowered so as to bring them back to their starting position, in unison with the pushers 314, as the columns 302, 338 are moved vertically by the pairs of cams 303, 304 and 330, 331 respectively.

Reference has been made above to the rejection of faulty bundles of cigarettes. It will be appreciated that, in order to detect such bundles, testing devices, which may be of any convenient known form, have to be provided at various positions in the machine. When a fault is detected, a signal from the associated testing device is fed, via a delay device of known form, to either or both of the solenoids 34 or, either or both solenoids 354, depending on whether it is desired to reject faulty bundles at position P9 or at position P19 respectively.

We claim:

1. Apparatus for forming overlapped wrappers for wrapping articles, such as groups of cigarettes, comprising means for cutting a web of wrapping material to form a succession of wrappers, each wrapper consisting of a large piece of web material and a small piece of web material, a larger carrier and a smaller carrier having substantially flat suction surfaces to receive said large and small pieces respectively, feed means to feed wrappers one at a time from said cutting means to said carriers, and conveyor means to convey wrappers received from said carriers towards the articles to be wrapped, said carriers being movable towards each other and being together movable between said feed means and said conveyor means, said suction surfaces of said carriers being arranged to hold said large and small pieces with their adjacent edge portions in different planes so that during movement of the carriers towards each other said pieces are brought into overlapping relationship.

2. Apparatus as claimed in claim 1 in which said conveyor means comprises a plurality of conveyors, each having associated therewith a pair of carriers, and in which the feed means comprises a rotatable suction drum and a suction roller associated with each pair of carriers and rotatable against the periphery of the drum, and valve means operable to regulate suction to the drum and to the rollers to effect a transfer of wrappers to each pair of carriers in turn, the rollers being so disposed about the drum that in use each pair of carriers simultaneously receives a wrapper from its associated roller.

3. Apparatus as claimed in claim 2 in which the conveyors are parallel to one another and perpendicular to the path along which the wrappers are fed by the feed means.

4. Apparatus as claimed in claim 1 in which the carriers are pivotally mounted below the feed means so that the suction surfaces face at least partly downwards when receiving a wrapper from the feed means.

5. Apparatus as claimed in claim 4 in which each carrier has a locating lip projecting from the suction surface along an edge nearest the axis of pivoting of the carrier and adapted to engage the leading edge of each wrapper piece received on the carrier, each said lip being resiliently mounted on the carrier for inward displacement relative to said suction surface so that upon depositing a wrapper piece on the conveyor means the lip is thus displaced by the conveyor means and disengages from said edge of the wrapper piece.

* * * * *